US006781490B2

(12) United States Patent
Funayama et al.

(10) Patent No.: US 6,781,490 B2
(45) Date of Patent: Aug. 24, 2004

(54) ELECTROMAGNETIC RELAY

(75) Inventors: Hideo Funayama, Ohtawara (JP); Hiromitsu Sato, Ohtawara (JP)

(73) Assignees: Taiko Device, Ltd., Ohtawara (JP); Hella KG Hueck & Co., Lipstadt (DE)

( * ) Notice: Subject to any disclaimer, the term of this patent is extended or adjusted under 35 U.S.C. 154(b) by 0 days.

(21) Appl. No.: 10/753,359

(22) Filed: Jan. 9, 2004

(65) Prior Publication Data

US 2004/0140873 A1 Jul. 22, 2004

Related U.S. Application Data

(63) Continuation of application No. 10/252,056, filed on Sep. 23, 2002, now abandoned.

(30) Foreign Application Priority Data

Oct. 5, 2001 (JP) ..... 2001-310044

(51) Int. Cl.[7] ..... H01H 51/22
(52) U.S. Cl. ..... 335/78; 335/83
(58) Field of Search ..... 335/78–86

(56) References Cited

U.S. PATENT DOCUMENTS 4,563,663 A 1/1986 Niekawa et al.
4,578,660 A 3/1986 Hanada et al.
4,709,219 A 11/1987 Nestlen et al.
4,727,344 A 2/1988 Koga et al.
4,837,538 A 6/1989 Dittmann
5,160,910 A 11/1992 Tsuji
6,075,429 A 6/2000 Uotome et al.
6,081,177 A 6/2000 Fausch
6,496,090 B1 12/2002 Nishida et al.

FOREIGN PATENT DOCUMENTS

JP A 4-357636 12/1992
JP A 10-162712 6/1998

*Primary Examiner*—Ramon M. Barrera
(74) *Attorney, Agent, or Firm*—Oliff & Berridge, PLC

(57) ABSTRACT

An electromagnetic relay includes a plurality of fixed contact terminals, a main body assembly formed by combining an electromagnetic assembly with an armature assembly, a terminal board having a plurality of pocket shaped recess portions engaged with the plurality of fixed contact terminals, and a convex band located on the terminal board so as to isolate the plurality of fixed contact terminals from each other, the convex band including a groove into which a back-stop metal or one of the plurality of fixed contact terminals is inserted, and a cover for receiving an electromagnetic relay main body formed by combining the main body assembly with the terminal board.

2 Claims, 20 Drawing Sheets

ELECTROMAGNETIC RELAY

BACKGROUND OF THE INVENTION

The present invention relates to an electromagnetic relay for use as a small electromagnetic relay that can be mounted on a printed-circuit board, for example.

In general, this kind of small electromagnetic relay has the following structure. Specifically, the electromagnetic relay includes a resin spool having flange portions formed at both sides of its cylindrical portion. The spool has coils wound thereat to form a coil assembly. The spool has an iron core inserted into its central axis position. The iron core exposes its head portion from the flange portion and this head portion serves as a portion to magnetically attract an armature by an electromagnet.

A yoke is shaped like a plate portion having a length nearly equal to the length of the spool in the axial direction. This yoke is attached to the spool in such state in which it may extend to the flange portions of both sides of the spool. The yoke has a movable contact spring attached to its plate portion. This movable contact spring is shaped at its flange portion side in which the head portion of the iron core is located such that it may be bent in the direction nearly perpendicular to the yoke. An armature made of a square steel plate is attached to the movable contact spring at it surface side in which its bent portion oppose the head portion of the iron core. Further, the movable contact spring includes a portion projecting to the direction parallel to the plate surface direction of the armature, and this projecting portion has a movable contact formed thereon.

A break (i.e., normally closed) fixed contact terminal and a make (i.e., normally open) fixed contact terminal are narrow L-like plates having predetermined widths and a break contact and a make contact are provided at tip end portions of the L-like plates. The break fixed contact terminal and the make fixed contact terminal are fitted into the grooves formed at the flange portion of the spool with pressure and thereby attached.

In the case of the conventional electromagnetic relay having the above-mentioned structure, since the break fixed contact terminal and the make fixed contact terminal are directly fixed to the resin spool, there is a risk that the following problems arise.

Specifically, while a drive current is flowing through the coils of the electromagnetic relay, when the movable contact and the make contact are connected and an excess current flows through the movable contact and the make contact due to an accident, the drive current causes the coils to generate heat and conductor portions such as the movable contact spring and the fixed contact terminal generate heat. When the coil and the conductor portions generate heat, the heat thus generated fuses the resin spool. When the resin spool is fused by heat, there occurs an abnormal state in which the movable contact and the make contact are fixed in the "ON mode" which is the connected state.

Thereafter, even when an interlayer short circuit (i.e., so-called coil layer short) occurs in the coil, the movable contact does not return to the break contact side and the movable contact is still connected to the make contact.

If the mode of the electromagnetic relay is "ON mode" when such trouble occurred in the electromagnetic relay, then an excess current continues to flow through the make contact, There is then a risk that other trouble will occur.

In the case of the above conventional electromagnetic relay, the break fixed contact terminal and the make fixed contact terminal are fitted into the grooves of the flange portions of the spool with pressure. When the break fixed contact terminal and the make fixed contact terminal are fitted into the grooves with pressure, the fixed contact terminals made of made of copper alloys cut the resin spool to produce shavings, and shavings are scattered around the fixed contact terminals. Contact sets of the movable contact, the break contact and the make contact exist near the pressure engagement portions (i.e. groove portions formed at the flange portions of the spool). Since scattered shavings lie between these contacts, there is a risk that a trouble of contact failure will occur between these contacts.

As an electromagnetic relay which can solve the above-mentioned problems, the inventors of the present application has previously proposed the following electromagnetic relay (see Japanese laid-open Patent Publication No. 162712/1998).

The previously-proposed electromagnetic relay comprises a main body assembly, formed by combining an electromagnet assembly comprising a coil assembly comprising of a spool and coils wound around the spool and an iron core and a yoke with a movable contact and an armature, and a terminal board assembly having fixed contact terminal attached to a terminal board. These main body assembly and terminal board are separate members and engage with each other to comprise an electromagnetic relay.

FIGS. 1A to 1D of the accompanying drawings are diagrams to which reference will be made in explaining the outline of this previously-proposed electromagnetic relay. In the electromagnetic relay of this example, a main body assembly 1 shown in FIG. 1A and a terminal board assembly 2 shown in FIG. 1B are assembled to form an electromagnetic relay main body 3 shown in FIG. 1D.

In the example shown in FIGS. 1A to 1D, the electromagnetic relay main body 3 is formed by assembling the two members of the main body assembly 1 and the terminal board assembly 2. The electromagnetic relay main body 3 is housed within a cover 4 shown in FIG. 1C. Then, a sealant seals the opening portion of the cover 4 to complete the electromagnetic relay.

The main body assembly 1 comprises an electromagnet assembly 20 and an armature assembly 30. The electromagnet assembly 20 comprises a coil assembly 10 and an iron core (not shown) and a yoke 21, both of which are attached to the coil assembly 10. The coil assembly 10 comprises a resin spool 11 including square plate-like flange portions 11*a* and 11*b* provided at respective ends thereof, a coil 13 wound around the spool 11 and coil terminals 12*a* and 12*b*, made of copper alloys, for example, attached thereof.

The flange portion 11*a* has a projection portion 11*c* projecting in the direction perpendicular to the plane of the plate thereof. This projection portion 11*c* serves as an engagement portion when the coil assembly 10 is fitted into the terminal board assembly 2. The flange portion 11*b* has a projection portion 11*d* serving as an engagement portion when the coil assembly 10 is fitted into the terminal board assembly 2, as will be described later on. The projection portion 11*d* projects from the upper surface of the flange portion 11*b* to the direction parallel to the central axis direction of the coil winding portion.

The armature assembly 30 comprises a substantially L-like movable contact spring 31 made of a copper alloy, for example, and a square plate-like armature 32 made of steel attached to the movable contact spring 31.

The terminals strip assembly 2 includes a terminal board 40 shown in FIG. 2A into which a make fixed contact terminal 50 shown in FIG. 2B and a break fixed contact terminal 60 are fitted and is shaped as shown in FIG. 2D.

The terminal board 40 is made of resin and shaped like a thin plate by molding. Specific shape and structure of the terminal board 40 will be described with reference to FIGS. 3A to 3I and FIGS. 4A and 4B.

FIG. 3A is a front view showing the terminal board 40 from a surface 40*a* of the side from which the make fixed contact terminal 50 and the break fixed contact terminal 60 are fitted into the terminal board 40 (i.e. opposite side of a surface 40*b* shown in FIG. 2A). FIG. 3B is a side view of the terminal board 40, and FIG. 3C is a top view of the terminal board 40.

FIG. 3D is a cross-sectional view taken along the line D—D in FIG. 3A. FIG. 3E is a cross-sectional view taken along the line E—E in FIG. 3A. FIG. 3F is a cross-sectional view taken along the line A—A in FIG. 3A. FIG. 3G is a cross-sectional view taken along the line B—B in FIG. 3A. FIG. 3H is a cross-sectional view taken along the line C—C in, FIG. 3A. FIG. 3I is a cross-sectional view taken along the line F—F in FIG. 3B.

FIG. 4B is a diagram showing the terminal board 40 from the side of the surface 40*b* in which the terminal board 40 is fitted into the main body assembly 1. FIG. 4A is a cross-sectional view taken along the line G—G in FIG. 4B.

As shown in FIG. 3A, the terminal board 40 is provided with engagement recesses 41, 42, 43, 44, 45. Into the engagement recesses 41, 42, 43, 44, 45, there are fitted engagement projection plates, which will be described later on, formed on the make fixed contact terminal 50 and the break fixed contact terminal 60. The engagement recesses 41, 42, 43, 44, 45 are dead recesses as shown in FIGS. 3D, 3E, 3F, 3G, 3H. In the case of this example, the engagement recesses 41 and 44 serve to engage the make fixed contact terminal 50 with the terminal board 40 and the engagement recesses 42, 43 and 45 serve to engage the break fixed contact terminal 60 with the terminal board 40.

The terminal board 40 has, at its surface 40*b* side, engagement portions which are engaged with the main body assembly 1. Specifically, the terminal board 40 has at its surface 40*b* side recesses 46*a*, 46*b* in which there is disposed the portion of the coil 13 of the main body assembly 1. Further, as shown in FIG. 3G and FIGS. 4A, 4B, the terminal board 40 has at its surface 40*b* side a recess 47 into which there is fitted the projection portion 11*d* formed on the flange portion 11*b* of the coil 11 shown in FIG. 1A.

A height h of the major plate portion of the terminal board 40 is shorter than a height of the spool 11 (length from the bottom portion of the flange portion 11*c* to the upper surface of the flange portion 11*b*). Therefore, as will be described later on, the major plate portion in which the engagement recesses 41 to 45 are formed on the terminal board 40 may be inhibited from being located around the portion in which the movable contact and the fixed contacts are located.

Then, the terminal board 40 has a projection portion 48 projecting from the major plate portion to the plane direction of the plate portion. The recess portion 47 is formed on this projection portion 48.

The terminal board 40 has, at its surface 40*b* side, an engagement projection member 49 including a through-hole 49*a* which is fitted with the projection portion 11*c* formed on the flange portion 11*a* side of the spool 11. This engagement projection member 49 is a thin U-like plate member projecting from the bottom portion 40*c* of the terminal board 40 in the height direction to the direction perpendicular to the plane of the plate of the terminal board 40. The engagement projection member 49 can deviate in the plate thickness direction of the engagement projection member 49 relative to the terminal board 40 under spring force.

Further, the terminal board 40 has, at its surface 40*b* side, a recess portion 40*d* which is flush with the upper surface of the engagement projection member 49 as shown in FIGS. 3F, 3G, 3H and 3I. The recess portion 40*d* accepts a coil end connection portion of a coil terminal to which a winding start end and a winding ending end of the coil 13 are connected when the main body assembly 1 is fitted into the terminal board assembly 2.

The make fixed contact terminal 50 and the make fixed contact terminal 60 which are engaged to the terminal board 40 will be described more in detail with reference to FIGS. 5A, 5B, 5C and FIGS. 6A, 6B, 6C.

Specifically, FIGS. 5A, 5B, 5C are a top view, a front view and a side view of the make fixed contact terminal 50, respectively. FIGS. 6A, 6B, 6C are a top view, a front view and a side view of the break fixed contact terminal 60, respectively.

As shown in FIGS. 5A to 5B and FIGS. 6A to 6C, the make fixed contact terminal 50 and the break fixed contact terminal 60 include plate portions 50*a* and 60*a* which are curved along the plane of the plate of the terminal board 40 when they are fitted into the terminal board 40. The make fixed contact terminal 50 and the break fixed contact terminal 60 have formed thereon external terminal portions 51 and 61 projecting from the bottom portion 40*c* of the terminal board 40 to the plane direction of the terminal board 40 as extended portions of the plate portions 50*a* and 60*a*.

The plate portions 50*a* and 60*a* of the make fixed contact terminal 50 and the break fixed contact terminal 60 have, at their sides opposite to the external terminal portions 51 and 61, plate portions 50*a* and 60*a* bent in the direction perpendicular to the plate portions 50*a* and 60*a*. The plate portions 50*b* and 60*b* include make fixed contacts 52, 53 and break fixed contacts 62, 63.

The plate portions 50*a* and 60*a* have, at their intermediate positions between the plate portions 50*a* and 50*b* in which the contacts 52, 53 and the contacts 62, 63 are formed and the external terminal portions 51 and 61, engagement projection plate portions 54, 55 and 64, 65, 66 which are fitted into the engagement recesses 41 to 45 of the terminal board 40 with pressure in the direction perpendicular to the plate portions 50*a* and 60*a*.

Then, the engagement projection plate portions 54, 55 of the make fixed contact terminal 50 are fitted into the engagement recess portions 41, 44 of the terminal board 40 with pressure, whereby the make fixed contact terminal 50 is fixed to the terminal board 40. In a like manner, the engagement projection plate portions 64, 65, 66 of the break fixed contact terminal 60 are fitted into the engagement recess portions 42, 43, 45 of the terminal board 40 with pressure, whereby the break fixed contact terminal 60 is fixed to the terminal board 40. FIG. 7 shows the state in which the make fixed contact terminal 50 and the break fixed contact terminal 60 are fixed to the terminal board 40.

As shown in FIG. 7, part of the make fixed contact terminal 50 and part of the break fixed contact terminal 60 cross at the engagement recess portion 44. Since however the engagement projection plate portion 55 of the make fixed contact terminal 50 and which engages with the engagement recess portion 44 is shaped as U-like plate portion as shown in FIG. 2B and the corresponding portion of the plate portion 50*b* of the make fixed contact terminal 50 is recessed as shown in FIGS. 2B and 5A, the make fixed contact terminal

50 and the break fixed contact terminal 60 are not in contact with each other and are electrically separated from each other.

The make fixed contacts 52, 53 and the break fixed contacts 62, 63 are spaced apart from each other by a predetermined distance as shown in FIGS. 2D and 7. A distance h2 (see FIG. 5B) ranging from the position of the engagement projection plate portion 55 of the make fixed contact terminal 50 to the plate portion 50 in which the make fixed contacts 52, 53 are formed is selected to be larger than a distance h1 (see FIG. 3A) ranging from then position of the engagement recess portion 44 of the terminal board 40 to an end edge 40*e* of the major plate portion in the height direction, except the projection portion 48 of the terminal board 40 (h1<h2). As a consequence, the plate portion 50*b* of the make fixed contact terminal 50 and the end edge 40*e* of the major plate portion of the terminal board 40 are distant from each other along the height direction of the terminal board 40.

Consequently, the portion of the terminal board 40 made of resin except the projection portion 48 does not exist near the positions of the heights of the make fixed contacts 52, 53 and the break fixed contacts 62, 63. That is, even when the excess current flows through the movable contact and the make fixed contacts 52, 53 to produce heat in the coil during the electromagnetic relay is operating, the resin of the terminal board 40 hardly exists near the contact portions so that the movable contact and the make fixed contacts 52, 53 can be prevented from fixedly adhering.

Moreover, when the make fixed contact terminal 50 and the break fixed contact terminal 60 are fitted into the terminal board 40 with pressure, the engagement projection plate portions 54, 55 and the engagement projection plate portions 64, 65, 66 cut the portions within the engagement recess portions 41 to 45 so that shavings are produced inevitably. However, since the engagement recess portions 41 to 45 are the dead recess portions, the shavings are collected into the engagement recess portions 41 to 45 so that they can be prevented from being scattered to the outside. Therefore, there can be removed a risk that shavings are attached to the contact portions to cause contact failures.

When the movable contact is alternately switched to the make fixed contacts and the break fixed contacts, it is unavoidable that metal shavings are scattered due to butting and abrasion of contact metals. If metal plate portions of a plurality of fixed contact terminals are not exposed to the outside, or if a plurality of fixed contact terminals has sufficiently large spaces, there is then no risk that the above-mentioned metal shavings will short-circuit a plurality of fixed contact terminals.

However, in the case of the above-mentioned electromagnetic relay, as shown in FIG. 7, the make fixed contact terminal 50 and the break fixed contact terminal 60 are exposed to the side of one surface 40*a* of the terminal board 40 and the metal plate surfaces of the make fixed contact terminal 50 and the break fixed contact terminal 60 are brought in close contact with this surface 40*a*.

As a result, when the spacing between the metal plate portions of the make fixed contact terminal 50 and the break fixed contact terminal 60 is small, the above-mentioned metal shavings are accumulated in the gap space. There is a risk that the make fixed contact terminal 50 and the break fixed contact terminal 60 will be short-circuited.

SUMMARY OF THE INVENTION

In view of the aforesaid aspect, it is an object of the present invention to provide an electromagnetic relay in which problems caused by metal shavings produced when metal contacts are connected can be avoided.

According to an aspect of the present invention, there is provided an electromagnetic relay in which an electromagnetic relay main body having a plate portion made of an insulating material with a plurality of fixed contact terminals attached thereto is inserted into a cover. The plate portion includes a first engagement portion located at the position in which said plurality of fixed contact terminals are isolated from each other. And the cover includes a second engagement portion that engages with the first engagement portion at an inner wall surface to which the plate portion opposes when the electromagnetic relay main body is inserted into the cover.

According to the above-mentioned arrangement, in the electromagnetic relay in which the electromagnetic relay main body is inserted into the cover, respective metal plate portions of a plurality of fixed contact terminals fixed to the plate portion made of an insulating material are isolated by the engagement portion of the terminal board and the second engagement portion of the cover from a space standpoint.

Therefore, it can avoided such an accident in which metal shavings produced when the movable contact contacts with the fixed contact will fuse the metal plate portions of a plurality of fixed contact terminals to short-circuit a plurality of fixed contact terminals.

DESCRIPTION OF THE PREFERRED EMBODIMENTS

Electromagnetic relays according to embodiments of the present invention will be described below together with their assembly methods with reference to the drawings.

Figure 8A:
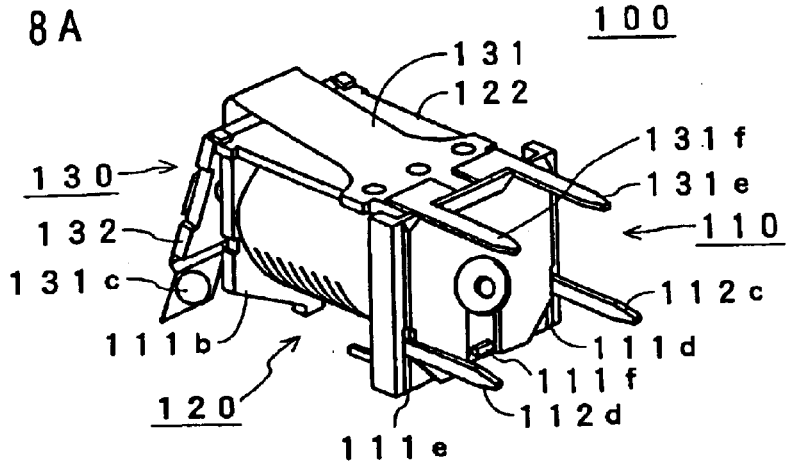
FIGS. 8A to 8D are exploded perspective views to which reference will be made in explaining an outline of a structure of an electromagnetic relay according to an embodiment of the present invention, respectively.
Figure 8B:
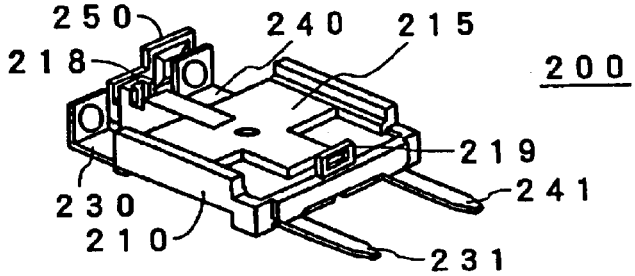
Figure 8C:
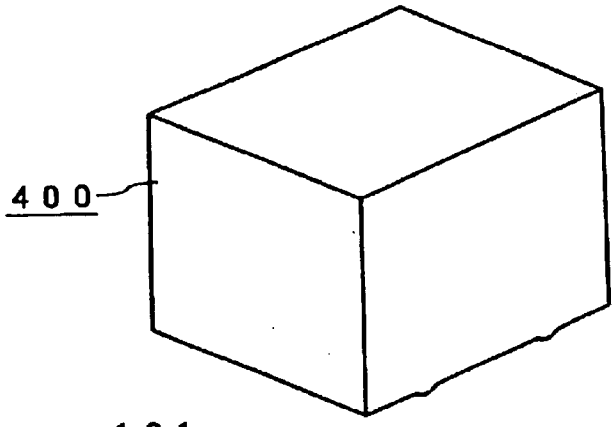
Figure 8D:
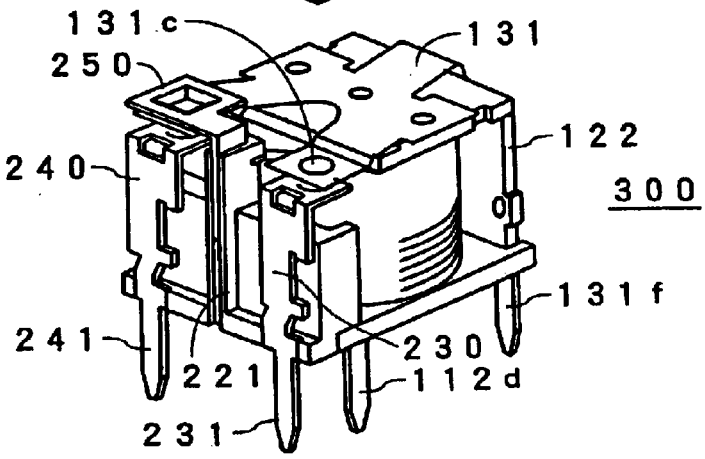

FIGS. 8A to 8D are diagrams to which reference will be made in explaining an outline of an electromagnetic relay according to this embodiment. In this embodiment, an electromagnetic relay main body 300 shown in FIG. 8D is formed by assembling a main body assembly 100 shown in FIG. 8A and a terminal board assembly 200 shown in FIG. 8B. The electromagnetic relay main body 300 is housed within a cover 400 shown in FIG. 8C. After the electromagnetic relay main body 300 has been housed within the cover 400, the sealant seals the opening portion of the cover 400 to complete the electromagnetic relay.

Figure 1A:
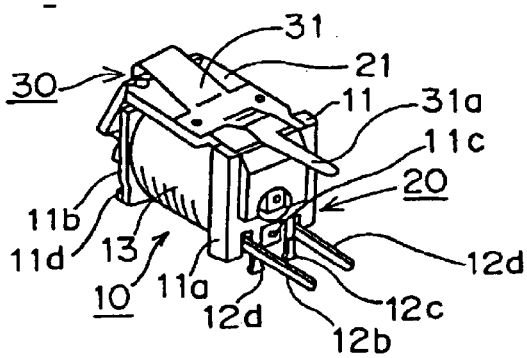
FIG. 1A PRIOR ART
FIGS. 1A to 1D are exploded perspective views to which reference will be made in explaining an example of an electromagnetic relay that has been previously proposed art, respectively.
Figure 1B:
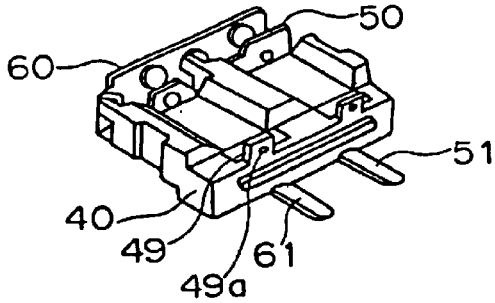
FIG. 1B PRIOR ART
Figure 1C:
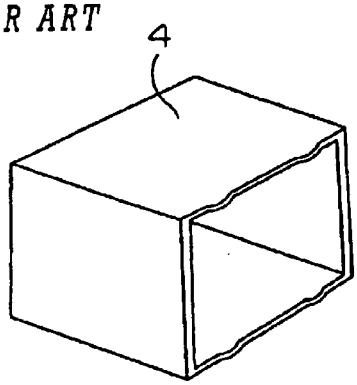
FIG. 1C PRIOR ART
Figure 1D:
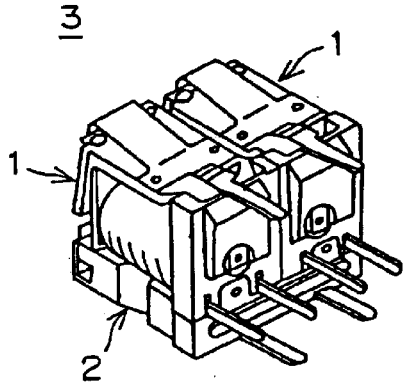
FIG. 1D PRIOR ART
Figure 2A:
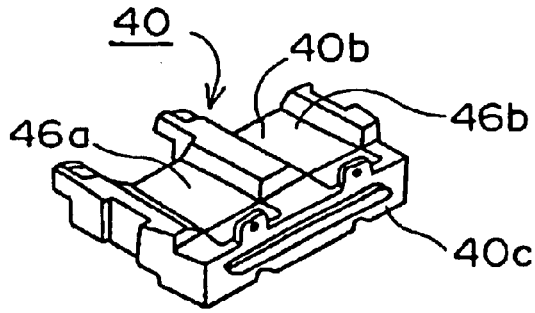
FIG. 2A PRIOR ART
FIGS. 2A to 2D are exploded perspective views to which reference will be made in explaining an example of a terminal board assembly of an electromagnetic relay that has been previously proposed, respectively.
Figure 2B:
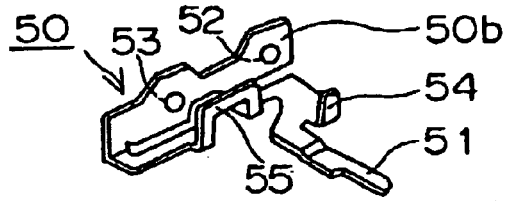
FIG. 2B PRIOR ART
Figure 2C:
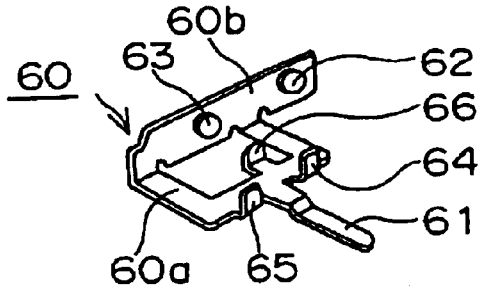
FIG. 2C PRIOR ART
Figure 2D:
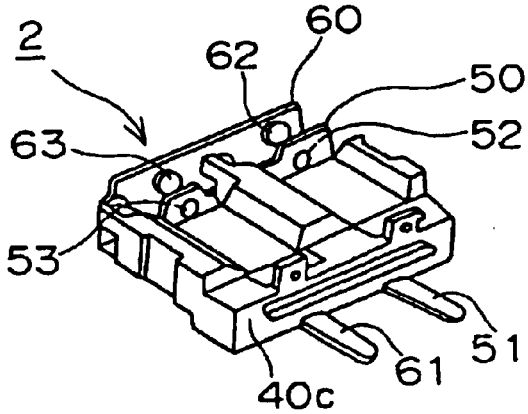
FIG. 2D PRIOR ART
Figure 3D:
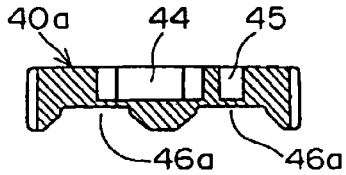
FIG. 3D PRIOR ART
FIG. 3D is a cross-sectional view taken along the line D—D in FIG. 3A.
Figure 3C:
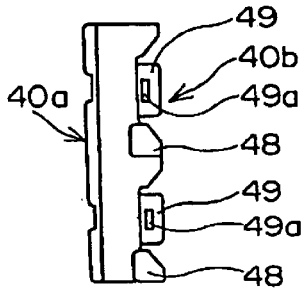
FIG. 3C PRIOR ART
FIG. 3C is a top view of the terminal board of a previously-proposed electromagnetic relay.
Figure 3E:
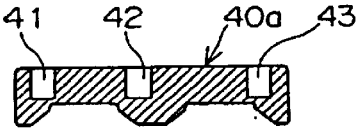
FIG. 3E PRIOR ART
FIG. 3E is a cross-sectional view taken along the line E—E in FIG. 3A.
Figure 3A:
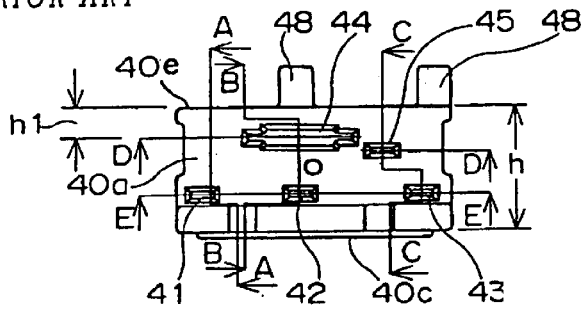
FIG. 3A PRIOR ART
FIG. 3A is a front view showing a terminal board of a previously-proposed electromagnetic relay.
Figure 3B:
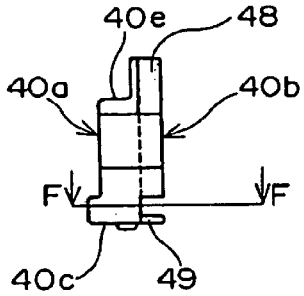
FIG. 3B PRIOR ART
FIG. 3B is a side view of the terminal board of a previously-proposed electromagnetic relay.
Figure 3F:
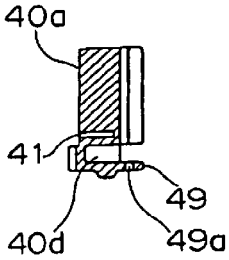
FIG. 3F PRIOR ART
FIG. 3F is a cross-sectional view taken along the line A—A in FIG. 3A.
Figure 3G:
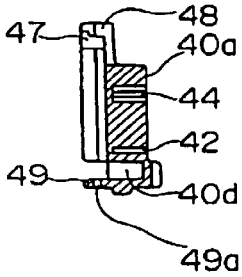
FIG. 3G PRIOR ART
FIG. 3G is a cross-sectional view taken along the line B—B in FIG. 3A.
Figure 3H:
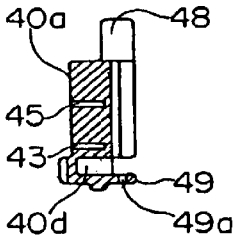
FIG. 3H PRIOR ART
FIG. 3H is a cross-sectional view taken along the line C—C in FIG. 3A.
Figure 3I:
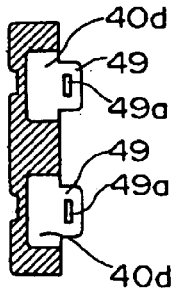
FIG. 3I PRIOR ART
FIG. 3I is a cross-sectional view taken along the line F—F in FIG. 3B.
Figure 4A:
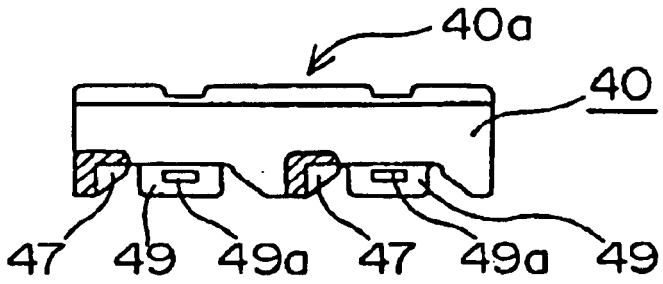
FIG. 4A PRIOR ART
FIG. 4A is a cross-sectional view taken along the line G—G in FIG. 4B.
Figure 4B:
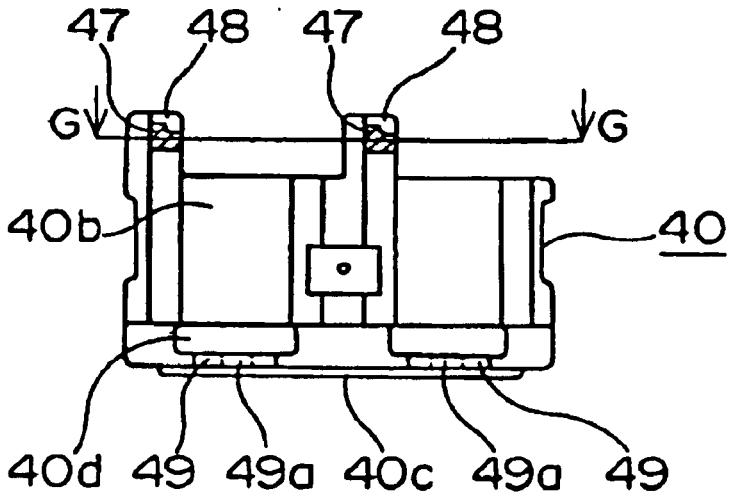
FIG. 4B PRIOR ART
FIG. 4B is a diagram showing a terminal board a previously-proposed electromagnetic relay from the side of the surface in which the terminal board is fitted into the main body assembly 1.
Figure 5A:
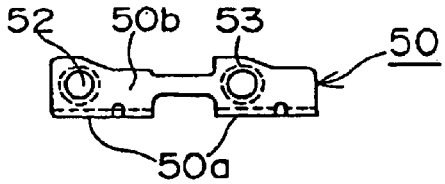
FIG. 5A PRIOR ART
FIGS. 5A to 5C are diagrams to which reference will be made in explaining an example of a fixed contact terminal of a previously-proposed electromagnetic relay, respectively.
Figure 5B:
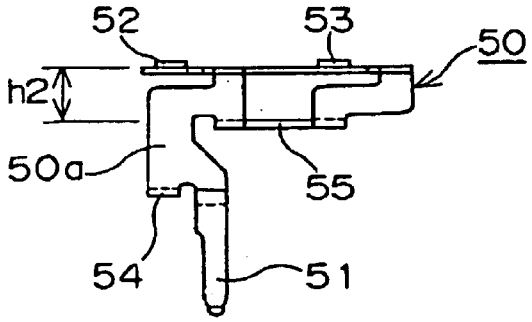
FIG. 5B PRIOR ART
Figure 5C:
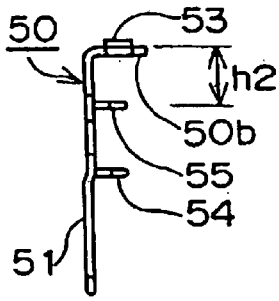
FIG. 5C PRIOR ART
Figure 6A:
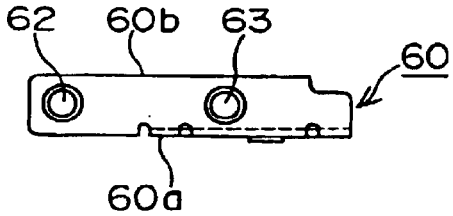
FIG. 6A PRIOR ART
FIGS. 6A to 6C are diagrams to which reference will be made in explaining an example of a fixed contact terminal of a previously-proposed electromagnetic relay, respectively.
Figure 6B:
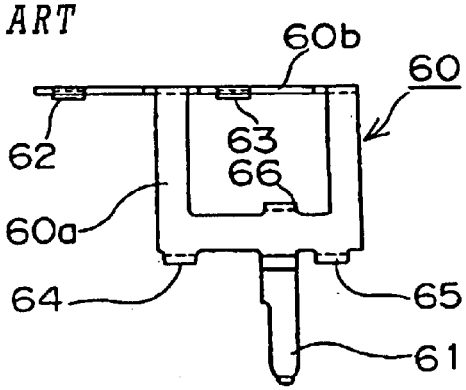
FIG. 6B PRIOR ART
Figure 6C:
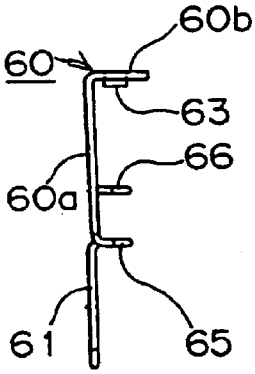
FIG. 6C PRIOR ART
Figure 7:
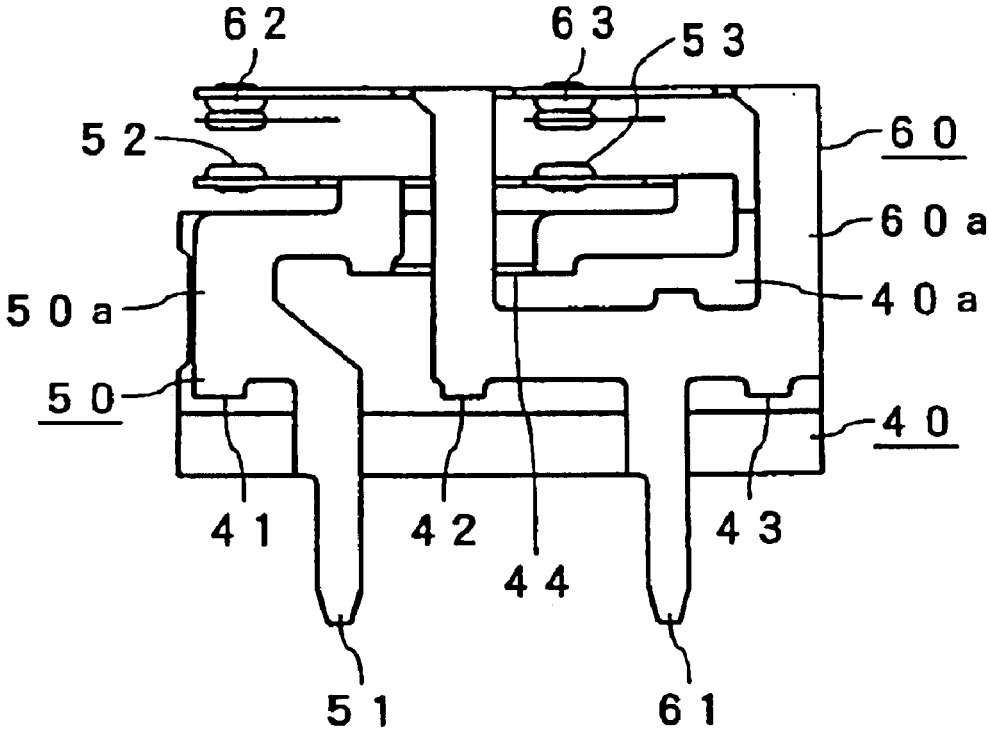
FIG. 7 PRIOR ART
FIG. 7 is a diagram to which reference will be made in explaining an example of a terminal board assembly of a previously-proposed electromagnetic relay.

The electromagnetic relay according to this embodiment, one electromagnet may open and close two contact pairs. Then, in this embodiment, as shown in FIG. 5D, one electromagnet can drive two movable contacts at the same time to open and close two make fixed contacts. In this embodiment, a break fixed contact is removed from this electromagnetic relay.

In this embodiment, the break fixed contact terminal including the break fixed contacts is replaced with a metal back-stop which serves to control the position of a movable contact of a movable contact spring.

The main body assembly 100 will be described.

Figure 11B:
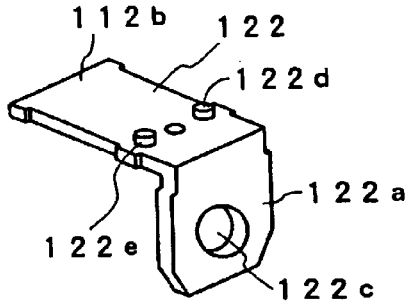
FIGS. 11A to 11D are exploded perspective views to which reference will be made in explaining an electromagnet assembly of an electromagnetic relay according to an embodiment of the present invention, respectively.
Figure 11A:
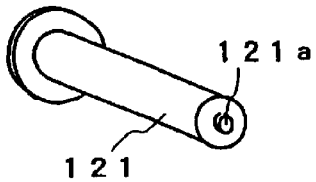
Figure 11C:
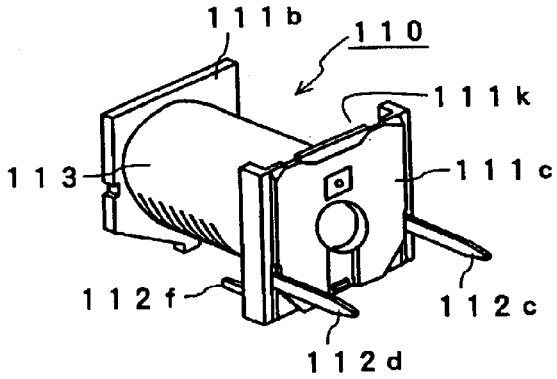

The main body assembly 100 comprises an electromagnet assembly 120 shown in FIGS. 11D and 12D and an armature assembly 130 shown in FIG. 12C which will be described later on. The electromagnet assembly 120 comprises a coil assembly 110 (see FIGS. 9C and 11C), an iron core 121 (see FIG. 11A) and a yoke 121 (see FIG. 11B) as shown in FIGS. 11A to 11C.

Figure 9A:
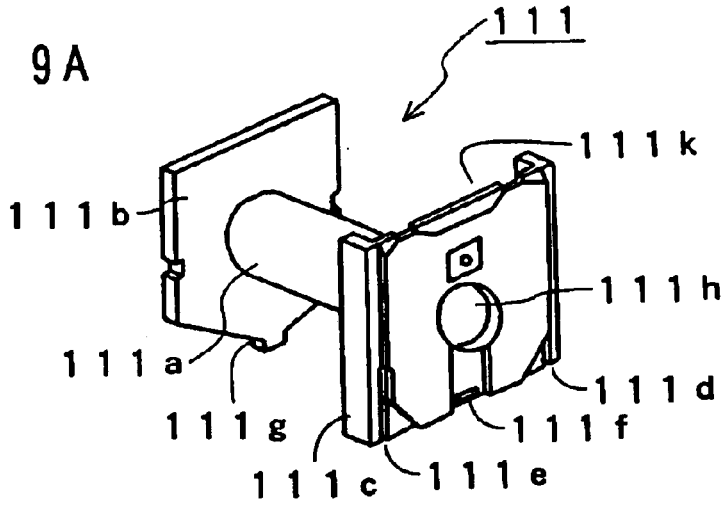
FIGS. 9A to 9C are exploded perspective views to which reference will be made in explaining a coil assembly of an electromagnetic relay according to an embodiment of the present invention, respectively.

The coil assembly 110 (see FIGS. 9C and 11C) comprise a spool 111 shown in FIG. 9A and a plate-like coil terminal 112 made of a copper alloy, for example, which is fitted into the spool 111. The spool 111 is made of an insulating resin and comprises a cylindrical coil winding portion 111*a* and square plate-like flange portions 111*b*, 111*c* formed at respective end portions of the cylindrical coil winding portion 111*a*.

The flange portions 111*b*, 111*c* have defined therein holes which can communicate with a hollow portion of the cylindrical coil winding portion 111*a*. The flange portion 111*c* has engagement grooves 111*d*, 111*e* to which there are fitted winding terminals 112*a*, 112*b*.

The flange portion 111*c* serves part of an external terminal board in which a plurality of external terminals electrically connected to respective portions of the electromagnetic relay main body 300 are placed when the electromagnetic relay main body 300 is inserted into the cover 400. The flange portion 111*c* has a recess portion 111*k* to accept the yoke 122 in the direction extending along the plane direction of the flange portion 111*c*.

Further, the flange portion 111*c* has a projection portion 111*f* projecting from the bottom surface of this flange portion 111*c* to the direction parallel to the central axis direction of the coil winding portion 111*a*. The flange portion 111*b* has a projection portion 111*g* projecting from the upper surface of this flange portion 111*b* to the direction parallel to the central axis direction of the coil winding portion 111*a*. These projection portions 111*f* and 111*g* serve as engagement portions which may engage with the terminal board assembly 200, as will be described later on.

Figure 10A:
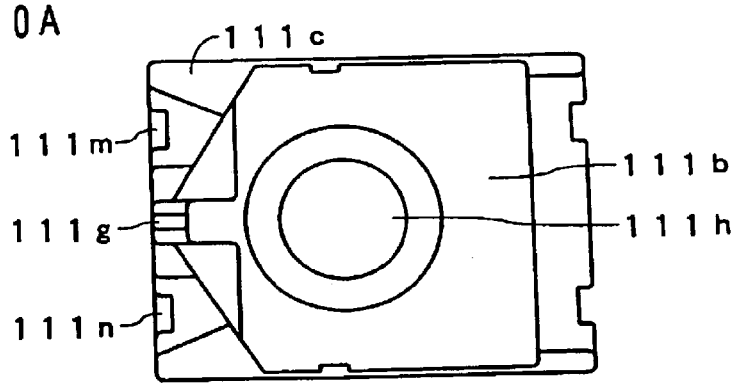
FIGS. 10A to 10C are diagrams useful for explaining a spool shown in FIG. 9A, respectively.
Figure 10B:
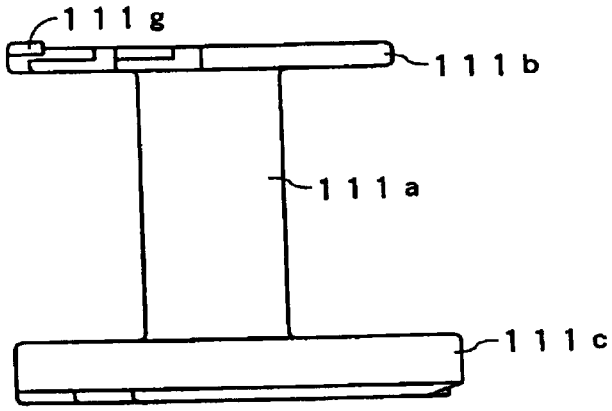
Figure 10C:
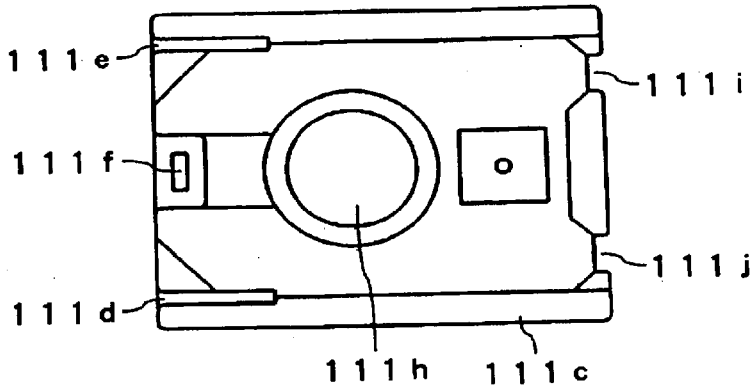

FIG. 10A is a top view showing the spool 111 from the side of the flange portion 111*b*. FIG. 10B is a side view of the spool 11. FIG. 10C is a bottom view showing the spool 111 from the side of the flange portion 111*c*. As shown in FIGS. 10A and 10C, the spool 111 includes a through-hole 111*h* into which an iron core 121 is inserted. As shown in FIG. 10C, the spool 111 includes recess portions 111 and 111*j* which engage with movable contact terminals which will be described later on.

The coil terminal 112 shown in FIG. 9 is made of a copper alloy, for example, and includes engagement portions 111*a*, 111*b* which engage with engagement grooves 111*d*, 111*e* formed on the flange portion 111*c* of the spool 111, coil external terminal portions 112*c*, 112*d* led out from the flange portion 111*c* to the opposite side of the flange portion 111*b* as shown in FIG. 8A when the engagement portions 112*a*, 112*b* engage the coil terminal 112 with the flange portion 111*c*, and projection portions 111*e*, 112*f* which are joined to one and the other end of the coil.

Figure 9B:
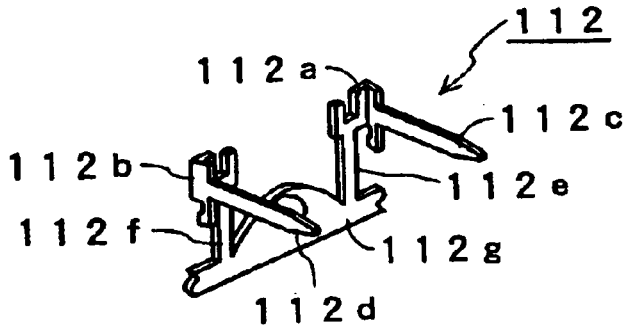

The projection portions 112*e*, 112*f* are bent toward the side of the coil winding portion 111*a* in the portions of the recesses 111*m*, 111*n* (FIG. 10A) of the flange portion 111*c* of the spool 111 after the coil terminal 112 has been engaged with the engagement grooves 111*d*, 111*e* of the spool 111. A frame portion 112*g* of the coil terminal 112 shown in FIG. 9B is removed by cutting after the coil terminal 112 has been engaged with the spool 111.

Figure 9C:
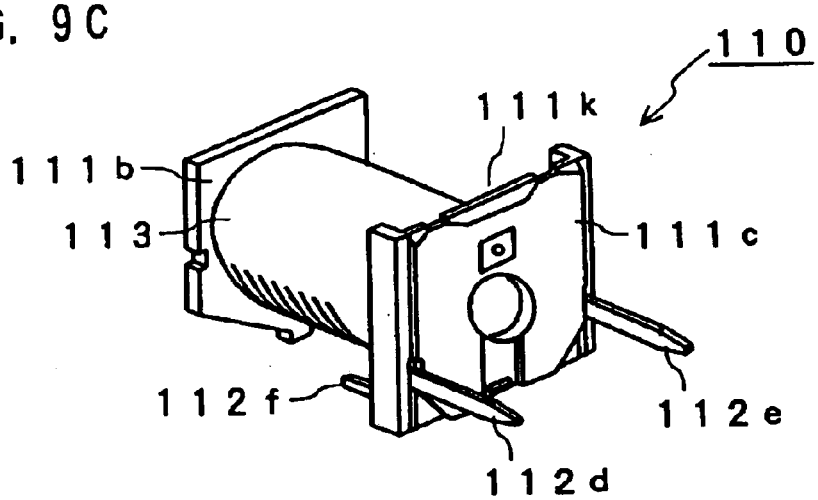

Then, a coil 113 is wound around the coil winding portion 111*a* of the spool 111 as shown in FIG. 9C. A winding start end and a winding ending end of the coil 113 are connected to the projection portions 112*e*, 112*f* of the coil terminal 112, respectively, and are electrically connected to the coil external terminal portions 112*c*, 112*d*.

Figure 11D:
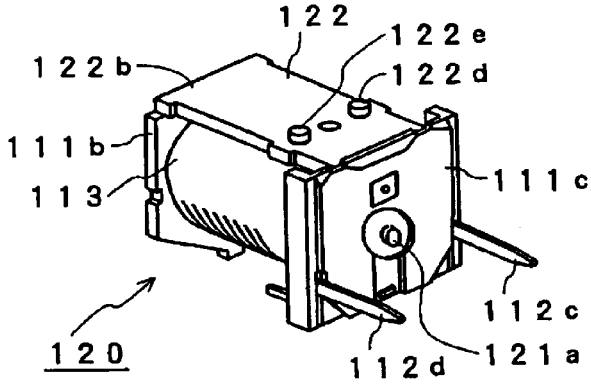

The electromagnet assembly 120 shown in FIG. 11D is formed by attaching the iron core 121 and the yoke 122 to the coil assembly 111 as shown in FIGS. 11A to 11D.

The iron core 121 is made of steel, for example, and is inserted from the side of the flange portion 111*b* of the spool 111 into the hollow portion of the cylindrical coil winding portion 111*a*. The yoke 122 is an L-like steel plate and includes a plate portion 122*a* inserted into the recess portion 111*k* formed at the flange portion 111*c* of the spool 111 and a plate portion 122*b* whose length extends from the flange portion 111*c* to the flange portion 111*b*. The plate portion 122*a* of the yoke 122 has a through-hole 122*c* which may communicate with the hollow portion of the coil winding portion 111*a*.

When the iron core 121 is inserted into the spool 111 under the condition in which the plate portion 122*a* of the yoke 122 is fitted into the spool 111, a top small-diameter portion 122*a* of the iron core 121 is exposed to the outside through through-hole 122*c* of the yoke 122 and through a hole defined a the corresponding position of the flange portion 111*c* as shown in FIG. 11D. Then, the iron core 121 is fixed to the spool 111by caulking the head of the small-diameter portion 122*a* of the iron core 121. Thus, the yoke 122 also is fixed to the spool 111.

In the state in which the yoke 122 is fixed to the spool 111, as shown in FIG. 11D, the plate portion 122*b* of the yoke 122 may link the flange portions 111*b* and 111*c* of the spool 111. The plate portion 122*b* of the yoke 122 is provided with caulking portions 122*d*, 122*e* that are used to attach a movable contact spring 131 which will be described later on.

In this manner, the electromagnet assembly 122 shown in FIG. 11D is formed and the main body assembly 100 is formed by attaching the armature assembly 130 to this electromagnet assembly 122 as shown in FIGS. 12A to 12E.

Figure 12A:
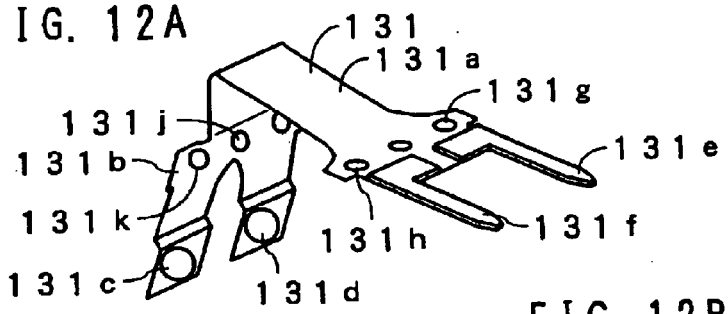
FIGS. 12A to 12E are exploded perspective views to which reference will be made in explaining a main body assembly of an electromagnetic relay according to an embodiment of the present invention, respectively.

FIG. 12A shows the movable contact spring 131 made of a resilient conductive material such as a copper alloy and which is bent as approximately L-like shape. This movable contact spring 131 includes a plate portion 131*a* attached to the plate portion 122*b* of the yoke 122 and the plate portion 131*b* that is curved in the direction substantially perpendicular to this plate portion 131*a*.

In the electromagnetic relay of this embodiment, the plate portion 131*b* of the movable contact spring 131 diverges as a Y-like shape to produce Y-like diverged portions. Movable contacts 131*c* and 131*d* are formed on tip ends of these Y-like diverged portions. On the other hand, movable contact external terminal portions 131*e* and 131*f* extend from the plate portion 131*a* of the movable contact spring 131. The movable contact external terminal portions 131*e* and 131*f* project in the same direction as those of the coil external terminal portions 112*c*, 112*d* when the movable contact spring 131 is attached to the electromagnet assembly 122 (see FIG. 12D). The plate portion 131*a* of the movable contact spring 131 has defined therein through-holes 131*g*, 131*h* that engage with the caulking portions 122*d*, 122*e* of the plate portion 122*b* of the yoke 122 of the electromagnet assembly 122.

Figure 12B:
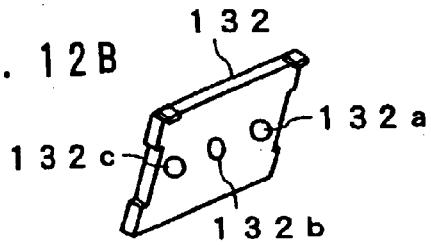
Figure 12C:
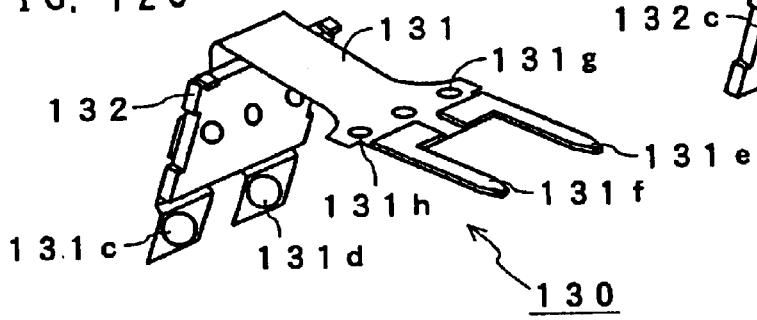
Figure 12D:
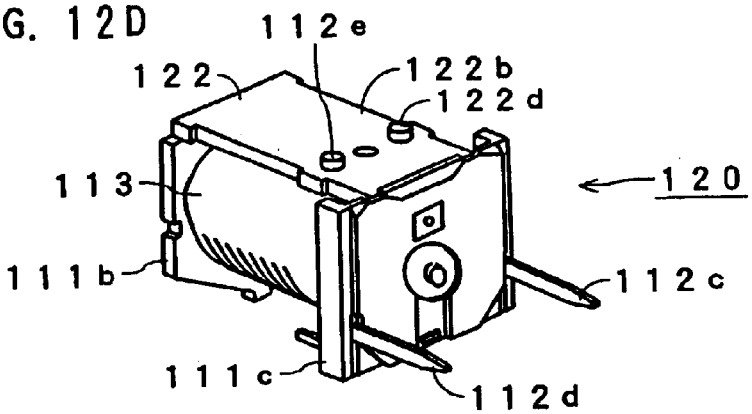

The armature 132 is a square plate-like armature made of steel, for example, as shown in FIG. 12B. The armature 132 is fixed to the plate portion 131*b* of the movable contact spring 131 by caulking in this embodiment in the state in which the plate portion 131*b* at its portion in which the two movable contacts 131*c* and 131*d* of the movable contact spring 131 are formed further projects from the armature 132 as shown in FIG. 12C.

To this end, the armature 132 has three caulking portions 132*a*, 132*b*, 132*c*, for example, formed thereon, and the plate portion 131*b* of the movable contact spring 131 has through-hole 131*i* (not shown), 131*j*, 131*k* defined at its positions opposing to these caulking portions 132*a*, 132*b*, 132*c*.

In this manner, the armature assembly 131 is formed by fixing the armature 132 to the movable contact spring 131. The caulking portions 122*d*, 122*e* of the plate portion 122*b* of the yoke 122 of the electromagnet assembly 122 shown in FIG. 12D are inserted into the through-holes 131*g*, 131*h* of the plate portion 131*a* of the movable contact spring 131 of this armature assembly 131, whereby the heads of the caulking portions 122*d*, 122*e* are caulked to attach the armature assembly 131 to the electromagnet assembly 122.

Figure 12E:
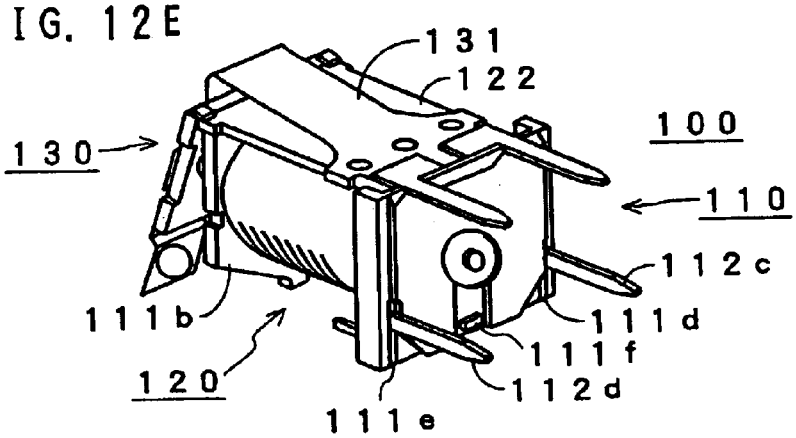

The main body assembly 100 shown in FIG. 12E is formed in this manner. In this main body assembly 10, the tip end portions of the movable contact spring 131, in which the two movable contacts 131*c* and 132*d* are formed project to the portion opposite to the side where the yoke 122 exists.

The terminal board assembly 200 will be described.

Figure 13A:
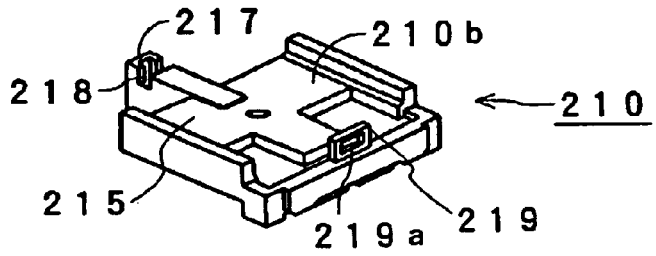
FIGS. 13A to 13D are exploded perspective views to which reference will be made in explaining a terminal board assembly of an electromagnetic relay according to an embodiment of the present invention, respectively.
Figure 13B:
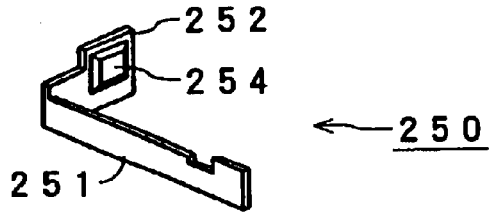
Figure 13C:
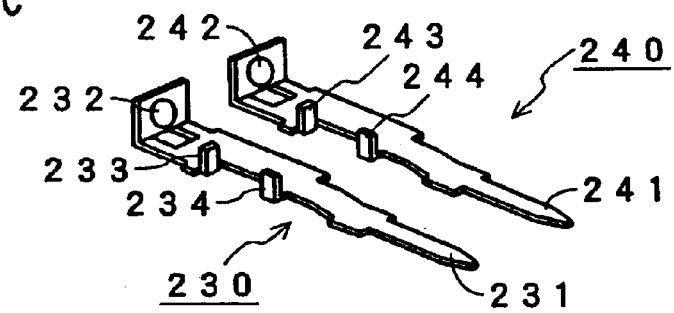
Figure 13D:
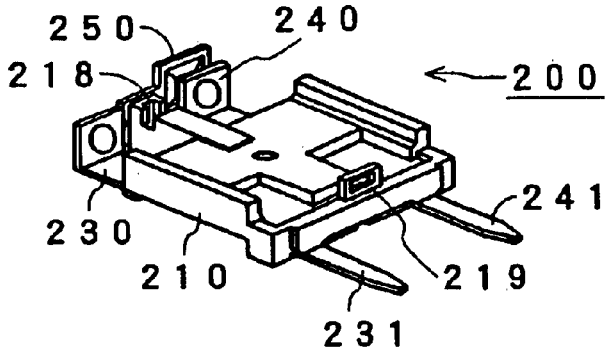

The terminal board assembly 200 is formed as shown in FIG. 13D such that two make fixed contact terminals 230, 240 shown in FIG. 13C and a back-stop 250 shown in FIG. 13B engage with the terminal board 210 shown in FIG. 13A.

The terminal board 210 is a thin plate-like terminal board made of resin by molding. Specific shape and structure of the terminal board 210 will be described with reference to FIGS. 14A to 14C, FIGS. 15A to 15C and FIGS. 16A to 16D. In these sheets of drawings, the height direction of the terminal board 210 is the direction parallel to the central axis direction of the coil winding portion 111*a* of the spool 111.

Figure 14A:
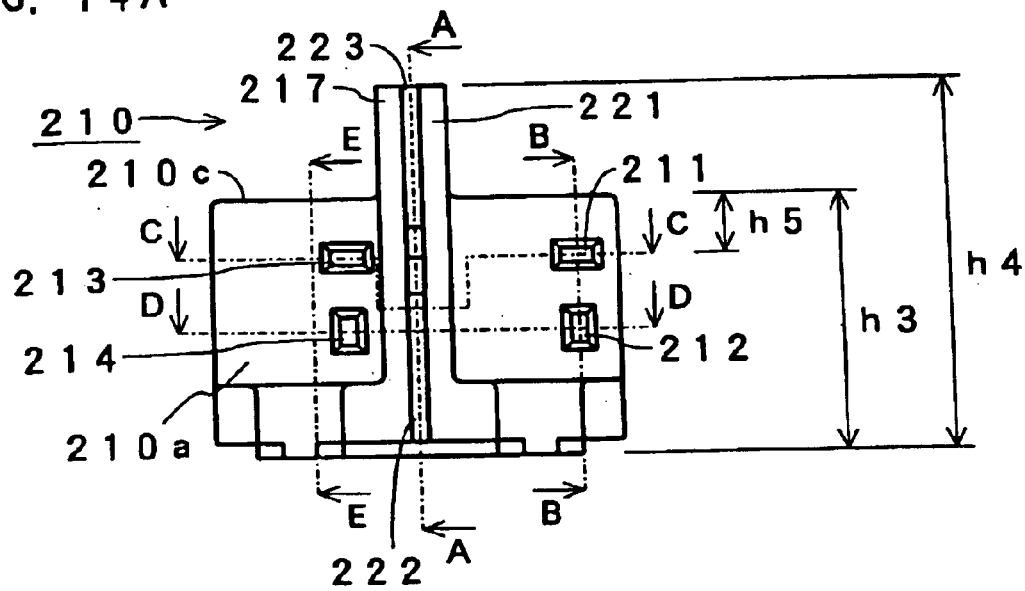
FIG. 14A is a front view showing a terminal board of an electromagnetic relay according to an embodiment of the present invention.
Figure 14B:
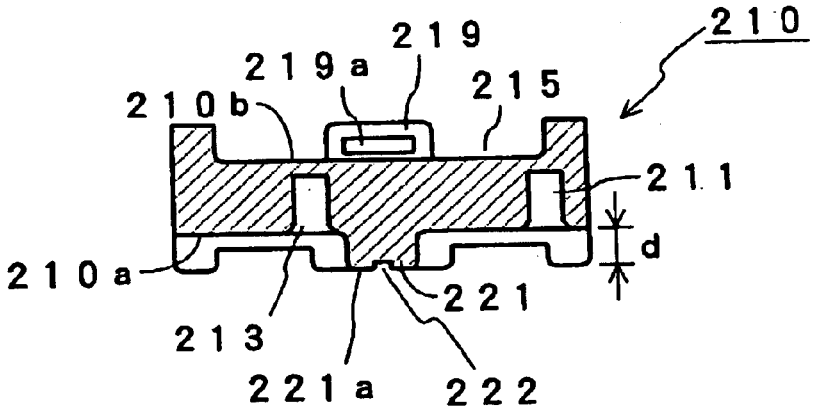
FIG. 14B is a cross-sectional view taken along the line C—C in FIG. 14A.
Figure 14C:
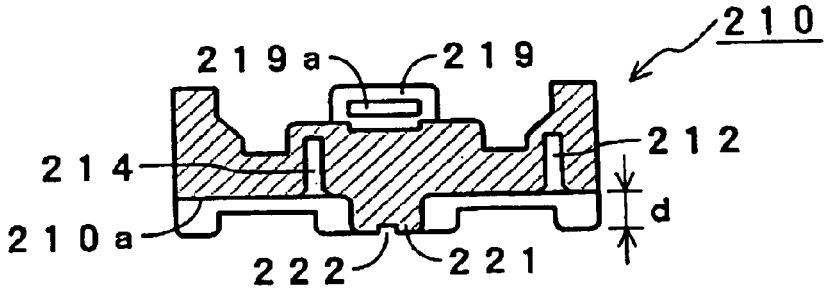
FIG. 14C is a cross-sectional view taken along the line D—D in FIG. 14A.
Figure 15A:
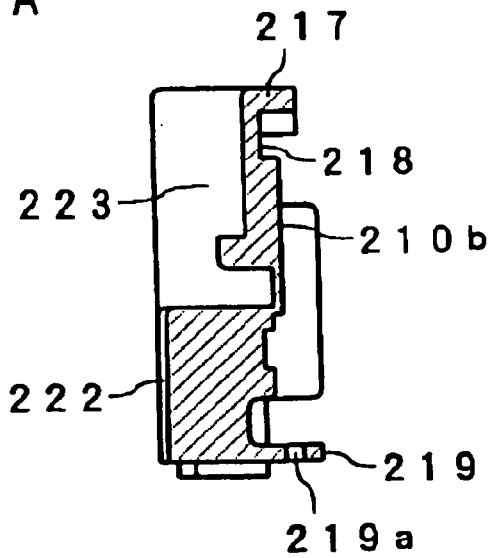
FIG. 15A is a cross-sectional view taken along the line A—A in FIG. 14A.
Figure 15B:
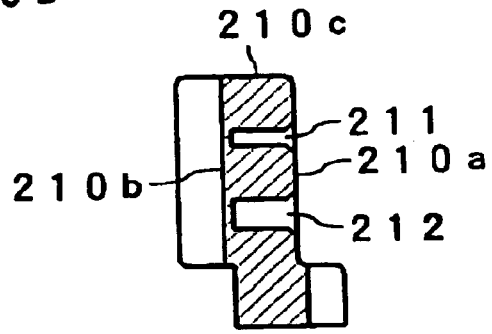
FIG. 15B is a cross-sectional view taken along the line B—B in FIG. 14A.
Figure 15C:
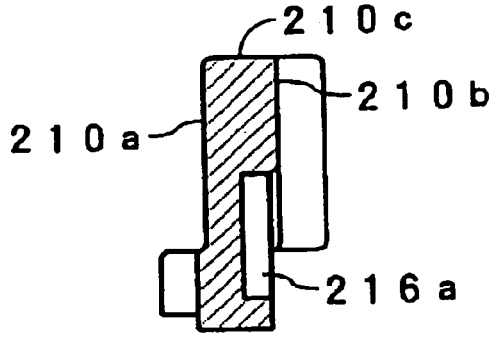
FIG. 15C is a cross-sectional view taken along the line E—E in FIG. 14A.

FIG. 14A is a front view showing the terminal board 210 from a surface 210*a* (opposite side of the surface 210*b* shown in FIG. 13A) into which the two make fixed contact terminals 230 and 240 are engaged and inserted. FIG. 14B is a cross-sectional view taken along the line C—C in FIG. 14A. FIG. 14C is a cross-sectional view taken along the line D—D in FIG. 14A. FIG. 15A is a cross-sectional view taken along the line A—A in FIG. 14A. FIG. 15B is a cross-sectional view taken along the line B—B in FIG. 14A. FIG. 15C is a cross-sectional view taken along the line E—E in FIG. 14A.

Figure 16A:
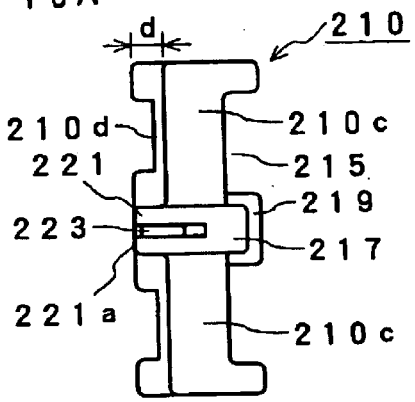
FIGS. 16A to 16D are diagrams to which reference will be made in explaining a terminal board of an electromagnetic relay according to an embodiment of the present invention, respectively.
Figure 16B:
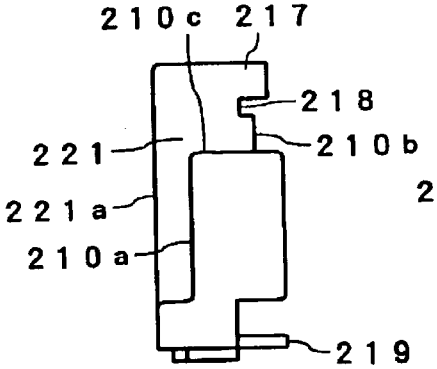
Figure 16D:
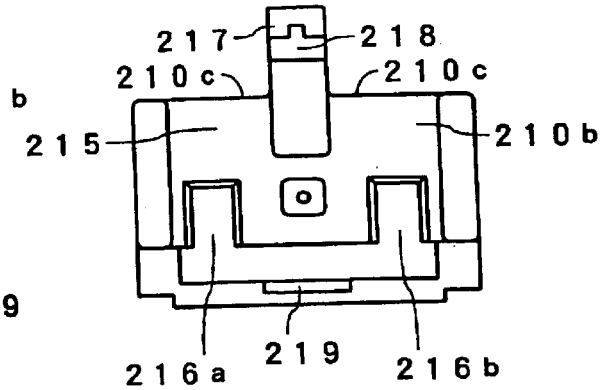
Figure 16C:
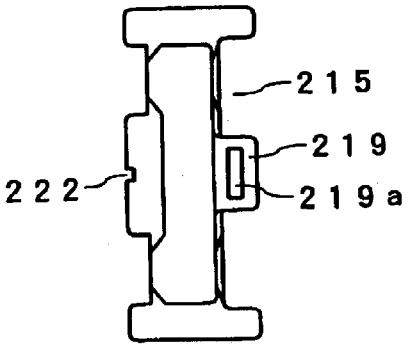

FIG. 16A is a top view of the terminal board 210. FIG. 16B is a side view of the terminal board 210. FIG. 16C is a bottom view of the terminal board 210. FIG. 16D is a rear view showing the terminal board 210 from the side of the surface 210 in which the terminal board 210 engages with the main body assembly 100.

As shown in FIG. 14A, the terminal board 210 includes a plurality of pocket shaped recess portions 211, 212, 213, 214 into which there are engaged engagement projection plate portions formed on the two make fixed contact portions 230, 240, which will be described alter on, with pressure. These recess portions 211 to 214 are pocked shaped recess portions as shown in FIGS. 14B, 14C and 15B. In the case of this embodiment, the engagement recess portions 211 and 212 serve to engage the make fixed contact terminal 230 with the terminal board 210 and the engagement recess portions 213 and 214 serve to engage the make fixed contact terminal 240 with the terminal board 210.

The terminal board 210 has at the side of its surface 210*a* formed a relief portion to prevent it from butting the main body assembly 100 when it is assembled to the main body assembly 100.

The terminal board 210 has, at the side of its surface 210*b* side, formed a recess portion 215 to locate therein the portion of the coil 113 of the main body assembly 100 and also has recess portions 216*a*, 216*b* to house therein portions of the projection portions 112*e*, 112*f* of the coil terminal 112 to which the coil starting end and the coil ending end of the coil 113 are connected.

A height h3 (see FIG. 14A) of the major plate portion of the terminal board 210 is shorter than the height (height from the bottom surface of the flange portion 111*c* to the upper surface of the flange portion 111*b*) of the spool 111 so that, as will be described later on, the major plate portion of the terminal board 210 where the engagement recess portions 211 to 214 are formed may not exist in the portions in which the movable contact and the fixed contacts are located.

However, as mentioned before, since the terminal board 210 has to form the portion which engages with the projection portion 111*f* of the flange portion 111*b* and the projection portion 111*g* of the flange portion 111*c* of the spool 111, the terminal board 210 includes a projection wall portion 217 projecting from the end face 210*c* of the major plate portion to the height direction of the terminal board 210.

A height h4 (see FIG. 14A) of the terminal board 210 at its projection wall portion 217 is selected to be slightly larger than a distance between the flanges 111*b* and 111*c*. Then, as shown in FIG. 15A, the projection wall portion 217 has, at the side of its surface 210*b* and near the tip end portion, a recess portion 218 which engages with the projection portion 111*f* of the flange portion 111*b* of the spool 111. In this embodiment, since the projection portion 111*f* of the flange portion 111*b* is formed at the central portion of the flange portion 111*b* along the lateral direction, the projection wall portion 217 also is formed at the central portion of the terminals strip 210 along the lateral direction (direction perpendicular to the height direction).

As shown in FIGS. 14B, 14C, 15A, the terminal board 210 has, at the side of its surface 210*b* of the bottom portion, an engagement projection member 219 including a through-hole 219*a* to which the projection portion 111*f* provided on the flange portion 111*c* of the spool 111 is fitted. The engagement projection member 219 is provided in such a manner that the thin U-like plate member may project from the bottom portion of the terminal board 210 in the height direction to the direction perpendicular to the plane of the plate of the terminal board 210. This engagement projection member 219 can deviate relative to the terminal board 210 under spring force.

In this embodiment, on the side of the surface 210*a* of the terminal board 210, there is formed a convex band 221 that extends in the height direction of the terminal board 210 so as to isolate the make fixed contact terminal 230 and the make fixed contact terminal 240 from each other from a space standpoint when the make fixed contact terminal 230 and the make fixed contact terminal 240 are fitted into the terminal board 210.

In this embodiment, this convex band 221 projects from the surface 210*a* of the terminal board 210 with a constant height and also has a square cross-section. In this embodiment, in order to separate the two make fixed contact terminals 230 and 240 from each other, the convex band 221 is formed on the terminal board 210 at its central portion of the lateral direction (direction perpendicular to the height direction). Accordingly, the convex band 221 extends also to the projection wall portion 217 at its surface of the surface 210*a* side.

Figure 17A:
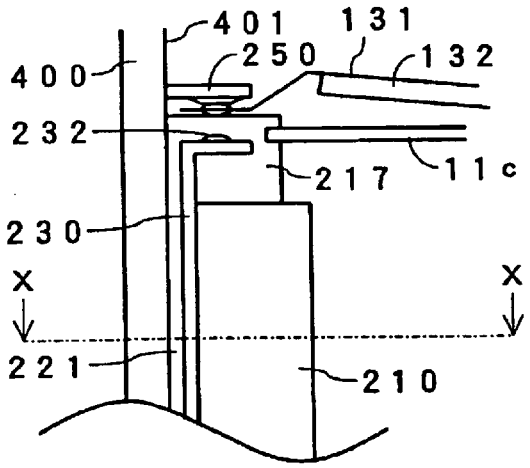
FIGS. 17A and 17B are diagrams useful for explaining a main portion of an electromagnetic relay according to the present invention, respectively.
Figure 17B:
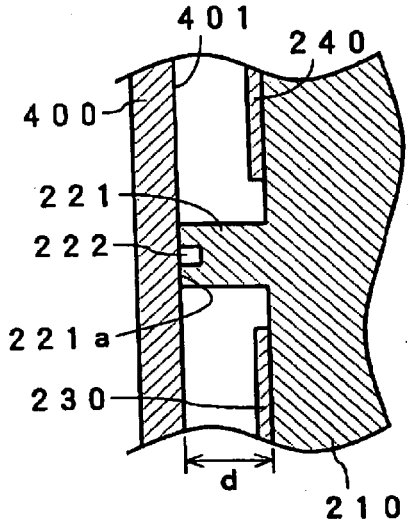

A height d (see FIG. 14C) from the surface 210*a* of the convex band 221 is properly selected such that the end face 221*a* of the convex band 221 in the height direction may closely contact with an inner wall surface 401 of the cover 400 as shown in FIG. 17A and FIG. 17B when the electromagnetic relay main body 300 is inserted into the cover 400. FIG. 17 is a fragmentary cross-sectional view of FIG. 17A.

The end face 221*a* of the convex band 221 has a narrow groove 222 extending over the total length of the convex band 221 along the height direction of the terminal board 210. The narrow groove 222 is formed at the center portion of the lateral direction in the convex band 221. The narrow groove 222 can oppose to the outside from the bottom surface of the terminal board 210 as shown in FIG. 16C. Consequently, when the electromagnetic relay main body 100 is inserted into the cover 400, the cover 400 and the convex band 221*b* contact with each other to make the narrow groove 222 become a narrow tube. Thus, when the sealant is injected into the side of the flange portion 111*c* to seal the opening portion of the cover 400, it can be expected that the sealant is injected into the narrow tube owing to a capillary attraction.

Further, in this embodiment, as shown in FIGS. 15A and 16A, the projection wall portion 217 has formed therein a dead deep groove 223 communicating with the narrow groove 222 in the height direction of the terminal board 210. A back-stop 250, which will be described later on, is fitted into the deep groove 223 with pressure. The deep groove 223 is shaped like a hooked-groove in accordance with the shape of the back-stop 250 that will be described later on.

Figure 18A:
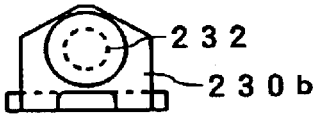
FIGS. 18A to 18C are diagrams useful for explaining a fixed contact terminal of an electromagnetic relay according to an embodiment of the present invention, respectively.
Figure 18B:
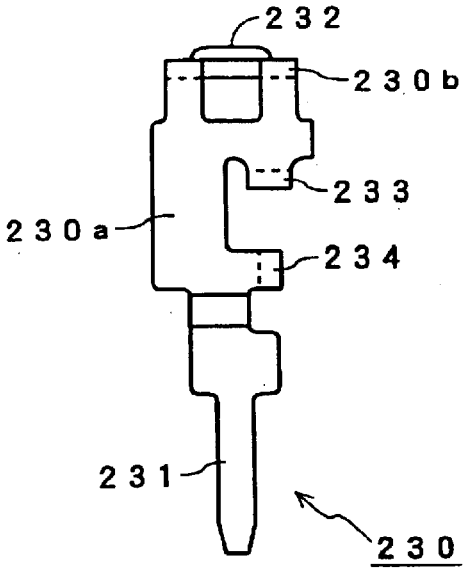
Figure 18C:
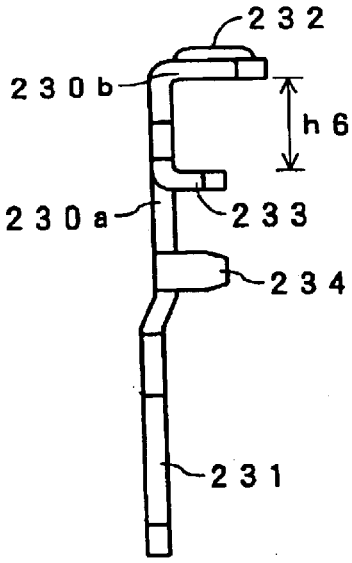

The make fixed contact terminals 230 and 240 that engage with the terminal board 210 are exactly the same in shape and are shown more in detail in FIGS. 15A to 18C. FIGS. 18A to 18C show the make fixed contact terminal 230 in which respective portions are denoted by reference numerals with the same two digits of 23. In the case of the make fixed contact terminal 240, the terminal board 210 includes respective portions that are denoted by reference numerals with the same two digits of 24.

Figure 19A:
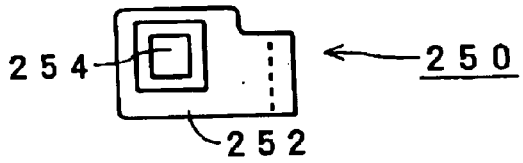
FIGS. 19A to 19C are diagrams to which reference will be made in explaining a back-stop of an electromagnetic relay according to an embodiment of the present invention, respectively.
Figure 19B:
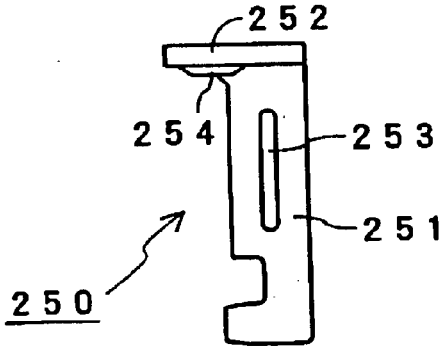
Figure 19C:
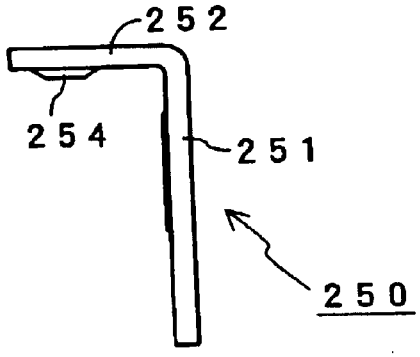

The back-stop 250 is illustrated in FIGS. 19A to 19C.

FIGS. 18A, 18D, 18C are a top view, a front view and a side view of the make fixed contact terminal 230, respectively. FIGS. 19A, 19B, 19C are a top view, a front view and a side view of the back-stop 250, respectively.

As shown in FIGS. 18A to 18C, the make fixed contact terminal 230 includes a plate portion 230*a* that can curve along the plate surface 210*a* of the terminal board 210 when the make fixed contact terminal 230 engages with the terminal board 210. Then, the make fixed contact terminal 230 has an external terminal portion 231 projecting from the bottom portion of the terminal board 210 to the plate surface portion 210*a* of the terminal board 210 as an extending portion of the plate portion 230*a*.

The plate portion 230*a* of the make fixed contact terminal 230 serves at its opposite side of the side of the external terminal portion 231 as a plate portion 230*b* that is bent in the direction perpendicular to the plate portion 230*a* The plate portion 230*b* has a make fixed contact 232 made of a conductive metal formed thereon.

The plate portion 230*a* has at the position of its intermediate portion engagement projection plate portions 233 and 234 that are fitted into the engagement recess portions 211, 212 of the terminal board 210 in the direction perpendicular to the plate portion 230*a*. In this case, a distance h6 (see FIG. 18C) between the engagement projection plate portion 233 and the plate portion 230*b* is selected to be larger than a distance h5 (see FIG. 14A) ranging from the position of the engagement recess portion 211 of the terminal board 210 to the end edge 210*c* of the terminal board 210.

As shown in FIGS. 19A and 19B, the back-stop 250 includes a plate portion 251, which is fitted into the deep groove 233 of the projection wall portion 217 of the terminal board 210 with pressure, and a plate portion 252 bent in the direction perpendicular to the plate portion 251.

As shown in FIG. 19B, the plate portion 251 is shaped like a hook corresponding to the shape of the deep groove 223 of the projection wall portion 217. Further, the plate portion 251 has a deformation portion 253 that can reliably engage the back-stop with it when the back-stop 250 is fitted into the deep groove 223 of the projection wall portion 217 with pressure.

The plate portion 252 has an abutting portion 254 that can abut with the movable contact 131*c* provided on the movable contact spring 131. In this embodiment, this abutting portion 254 is formed when the plate portion 252 is molded such that part of the plate portion 252 may project from the plate portion 251.

Then, the engagement projection plate portions 233, 234 of the make fixed contact terminal 230 are fitted into the engagement recess portions 211, 212 with pressure, whereby the make fixed contact terminal 230 is fixed to the terminal board 210.

As mentioned before, the engagement projection plate portion of the make fixed contact terminal 240 are fitted into the engagement recess portions 213, 214 with pressure, whereby the make fixed contact terminal 240 is fixed to the terminal board 210.

Further, the back-stop 250 is fixed to the terminal board 210 when the plate portion 251 is fitted into the deep groove 223 of the projection wall portion 217 of the terminal board 210 with pressure. Then, the make fixed contact terminals 230, 240 and the back-stop 250 are attached to the terminal board 210, thereby resulting in the terminal board assembly 200 being formed.

Figure 20:
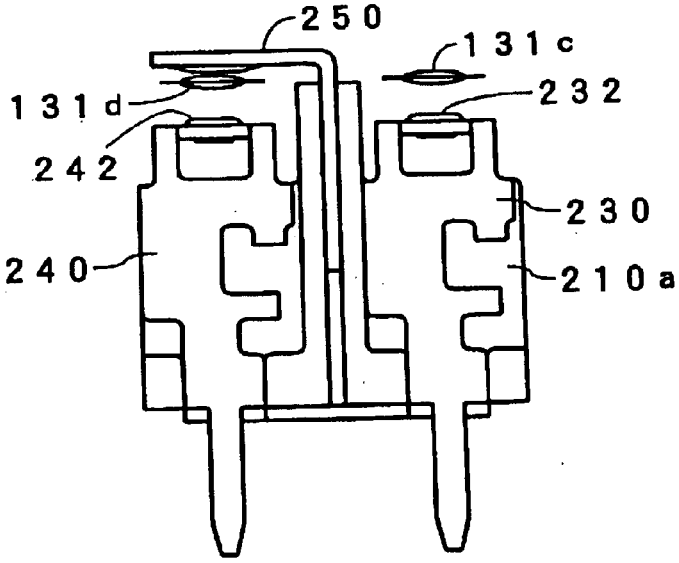
FIG. 20 is a diagram to which reference will be made in explaining a terminal board assembly of an electromagnetic relay according to an embodiment of the present invention.

FIG. 20 shows the terminal board assembly 200 from the side of the plate surface 210*a* of the terminal board. 210. As mentioned before, the distance h6 from the position of the engagement projection plate portion 233 of the make fixed contact terminal 230 to the plate portion 230*b* where the make fixed terminal 232 is formed is selected to be larger than the distance h5 from the position of the engagement recess portion 211 of the terminal board 210 to the end edge 210*c* of the major plate portion of the terminal board 210 in the height direction (h5<h6). For this reason, when the make fixed contact terminal 230 is fitted into and fixed to the terminal board 210, as shown in FIG. 20, the plate portion 230*b* of the make fixed contact terminal 230 and the end edge 210*c* of the major plate portion of the terminal board 210 are distant from each other in the height direction of the terminal board 210.

Similarly, when the make fixed contact terminal 240 also is fitted into and fixed to the terminal board 210, the make fixed contact 242 of the make fixed contact terminal 240 becomes distant from the end edge 210*c* of the major plate portion of the terminal board 210 by a predetermined distance in the height direction of the terminal board 210. Then, the abutment portion 254 of the back-stop 250 is located above the fixed contact 232 of the make fixed contact terminal 230.

As shown in FIG. 20 in an imaginary fashion, movable contacts 131*c*, 131*d*, provided on the movable contact spring 131, are located so as to oppose the make fixed contacts 232 and 242, and the movable contact 131*d* of the movable contact spring 131 is located in the space between the back-stop 250 and the make fixed contact 242 of the make fixed contact terminal 240.

The movable contact 131*d* abuts the back-stop 250 and is thereby controlled in position when the electromagnet is not excited. Although the back-stop is not provided on the side of the movable contact 131*c*, since the movable contacts 131*c* and 131*d* are both attached to the movable contact spring 131, when the movable contact 131*d* is controlled in position by the back-stop 250, the movable contact 131*c* also is controlled in position in correspondence therewith.

As described above, the portion of the terminal board 210 made of resin does not exist near the height positions of the make fixed contacts 232, 242 and the back-stop 250 except the projection wall portion 217. Specifically, even when excess current flows through the movable contact and the make fixed contact and heat is produced during the electromagnetic relay is operating, the resin of the terminal board 210, which fuses the movable contact and the make fixed contact, hardly exists near the contact portion.

When the make fixed contact terminals 230, 240 are fitted into the terminal board 210 with pressure, it is unavoidable that the engagement projection plate portions 233, 234 and the engagement projection plate portions 243, 244 cut the inside portions of the engagement recess portions 211 to 214 so that shavings are produced. In that case, since the engagement recess portions 211 to 214 are the pocket shaped recess portions, the shavings are accumulated within the engagement recess portions 211 to 214 and can be prevented from being scattered to the outside. Therefore, there is then no risk that the shavings attached to the contact portion will cause contact portion failure.

The terminal board assembly 200 thus formed is assembled to the main body assembly 100 to form the electromagnetic relay main body 300. Specifically, as shown in FIGS. 8A to 8D, in the state in which the portion of the coil 113 of the main body assembly 100 locates within the above recess portion 215*a* of the terminal board assembly 200 and the movable contacts 131*c*, 131*d* at the tip end of the movable contact spring 131 oppose the make fixed contacts 230, 240 of the terminal board assembly 200, the main body assembly 100 and the terminal board assembly 200 engage with each other to form the electromagnetic relay assembly 300.

At that time, in the state in which the projection portions 112*f*, 112*g* of the coil terminal 112 of the main body assembly 100 are housed within the above recess portions 216*a*, 216*b* of the terminal board 210 of the terminal board assembly 200, the projection portion 111*g* of the flange portion 111*b* of the spool 111 of the main body assembly 100 engages with the recess portion 218 of the projection wall portion 217 of the terminal board assembly 200 and the projection portion 111*f* of the flange portion 111*c* of the spool 111 of the main body assembly 200 is fitted into and thereby engaged with the through-hole 219*a* of the projection plate 219 of the terminal board assembly 200, the main body assembly 100 and the terminal board assembly 200 engage with each other.

In the state in which the main body assembly 100 and the terminal board assembly 200 engage with each other, the movable contact 131*d* abuts the abutment portion 254 of the back-stop 250 under spring force of the movable contact spring 131. Then, in the state in which the electromagnetic relay is operating while current is, flowing through the coil 113, the electromagnet magnetically attracts the armature 132 to the side of the iron core 121 to thereby connect the movable contacts 131*c*, 131*d* to the make fixed contacts 232, 242.

Then, the electromagnetic relay main body 300 is inserted into the case 400 and the opening portion of the case 400 is sealed by the sealant, thereby resulting in the electromagnetic relay being completed. At that time, as shown in FIG. 17B, part of the sealant enters the narrow tube 223 comprising the inner wall surface 401 of the cover 400 and the narrow groove 222 of the convex band 221 owing to a capillary attraction.

As shown in FIGS. 17A and 17B, when the electromagnetic relay main body 300 is inserted into the cover 400, the end face 221*a* of the convex band 221 provided on the terminal board 210 contacts with the inner wall surface 401 of the cover 400 to cause the plate portion 230*a* of the make fixed contact terminal 230 and the plate portion 240*a* of the make fixed contact terminal 240 to exist in another space (another room) formed by the separation consisted of the convex band 221 and the inner wall surface 401 of the cover 400. Thus, even though metal shavings are produced when the movable contacts 131*c*, 131*d* abut the make fixed contacts 232 and 242 and the abutment portion 254 of the back-stop 250, the metal shavings can be prevented from electrically short-circuiting the two make fixed contact terminals 230 and 240.

In the electromagnetic relay having the above arrangement according to this embodiment, since the electromagnetic relay main body is formed by engaging the separate assemblies of the main body assembly 100 and the terminal board assembly 200, heat generated from the coil and heat generated by excess current flowing through the contact terminal can be separated.

Then, since the terminal board assembly 200 is produced as the separate assembly of the main body assembly 100 and the fixed contact terminals 230, 240 are not attached to the spool 211 but attached to the terminals strip 210 and the resin portion, which forms the terminal board 210, can be avoided from existing near the fixed contacts 232 and 242 of the fixed contact terminals 230 and 240 as much as possible, in the state in which the movable contact 131*c* and/or 131*d* and the make fixed contact 232 and/or 242 are connected, they can be prevented from being fused when the resin is melted.

Therefore, when coil layer short occurs due to heat generated by excess current in the state in which drive current flows through the coil 113 of the electromagnetic relay main body 300 and the movable contacts 131*c*, 131*d* are connected to the make fixed contacts 232, 242, the movable contacts 131*c*, 131*d* return to the side of the back-stop 250.

Specifically, the trouble mode of the electromagnetic relay is placed in the off mode. Therefore, it becomes possible to prevent excess current from continuously flowing after the electromagnetic relay had been out of order.

Since the operation in which the fixed contact terminals 230 and 240 are fitted into the terminal board 210 with pressure is equal to the operation in which the projection plate portions 233, 234 and 243, 244 of the fixed contact terminals 230 and 240 are fitted into the dead recess portions 211 to 214 provided on the terminal board 210, produced shaving are accumulated within the recess portions 211 to 214. Therefore, shavings are hardly accumulated between the fixed contacts 230, 240 and the movable contacts 131*c*, 131*d*, and the occurrence of trouble of contact failure of the contact due to shavings can decrease.

Further, since a plurality of fixed contact terminals attached to the terminal board 210 are separated by the convex band 221 provided on the terminal board 210 and the inner wall surface 401 of the cover 400, it is possible to prevent a plurality of fixed contact terminals from being electrically short-circuited.

An electromagnetic relay according to another embodiment of the present invention will be described below.

While the electromagnetic relay according to the above embodiment can hold the electrical insulation of the fixed contact terminals of the two contact pairs having the two make fixed contact terminals, the present invention is not limited thereto and can be applied to an electromagnetic relay which can hold the electrical insulation between a break fixed contact terminal and a make fixed contact terminal of one contact pair.

In the electromagnetic relay according to this embodiment, the structure of the movable contact spring 131 of the main body assembly 100 in the electromagnetic relay according to the preceding embodiment is modified slightly. Moreover, with respect to the terminal board assembly 200 in the electromagnetic relay according to the preceding embodiment, the make fixed contact terminal 230 is replaced with a break fixed contact terminal 260 and the back-stop 240 is removed.

Figure 21A:
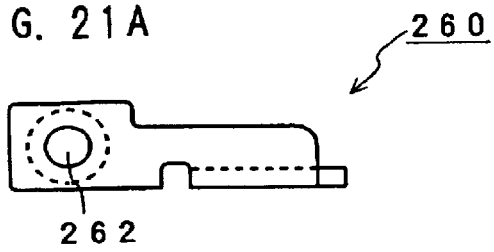
FIGS. 21A to 21C are diagrams to which reference will be made in explaining a fixed contact terminal for use with an electromagnetic relay according to other embodiment of the present invention, respectively.
Figure 21B:
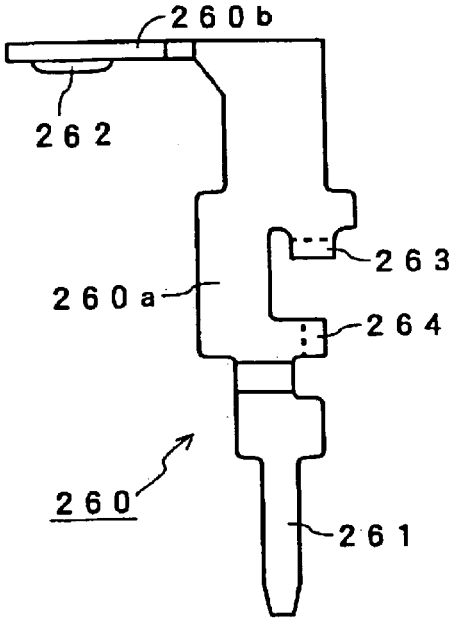
Figure 21C:
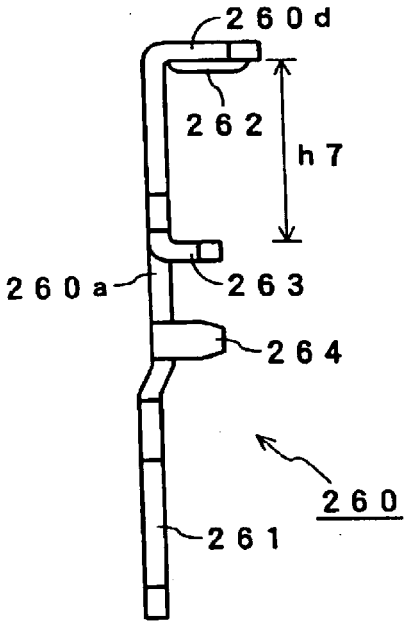

Specifically, in this embodiment, with respect to the movable contact spring 131, of the two Y-like tip ends, the portion of the side in which the movable contact 131*c* is removed and only the portion of the movable contact 131*d* is left, and the back-stop 250 is removed. Then, the make fixed contact terminal 230 is replaced with the break fixed contact terminal 260 shown in FIGS. 21A to 21C. FIGS. 21A to 21C are a top view, a front view and a side view of the break fixed contact terminal 260, respectively.

As shown in FIGS. 21B and 21C, the break fixed contact terminal 260 includes a plate portion 260*a* that can curve along the plate surface 210*a* of the terminal board 210 when the make fixed contact terminal 260 has engaged to the terminal board 210. Then, as the extending portion of the plate portion 260*a*, an external terminal portion 261 projecting from the bottom portion of the terminal board 210 in the direction extending along the plate surface 210*a* of the terminal board 210 is formed.

The plate portion 260*a* of the break fixed contact terminal 260 has a plate portion 260*b*, bent in the direction perpendicular to the plate portion 260*a*, formed at its side opposite to the side of the external terminal portion 261. The plate portion 260*b* has a break fixed contact 262, made of a conductive metal, formed thereon.

Engagement projection plate portions 263 and 264 which are fitted into the engagement recess portions 211, 212 of the terminal board 210 with pressure, are formed at the intermediate portion of the plate portion 260*a* in the direction perpendicular to the plate portion 260*a*.

In this case, the plate portion 260*b* of the break fixed contact terminal 260 has the arrangement such that the break fixed contact terminal 262 is located at the position of the abutment portion 254 of the back-stop 250 in the aforementioned embodiment when the break fixed contact terminal 260 is attached to the terminal board 210.

Specifically, as shown in FIG. 21C, a distance h7 between the engagement projection plate portion 263 and the plate portion 260*b* is selected to be larger than the distance h5 (see FIG. 14A) from the position of the engagement recess portion 211 of the terminal board 210 to the end edge 210*c* of the terminal board 210 and is also selected to be larger than the distance h6 (see FIG. 18C) between the engagement projection plate portion 243 of the make fixed contact terminal 240 and the plate portion 240*b*.

The plate portion 260*b* extends in the direction parallel to the surface 210*a* of the terminal board 210 in such a manner that the break fixed contact 262 is located at the position of the abutment portion 254 of the back-stop 250 in the aforementioned embodiment when the break fixed contact terminal 260 is mounted to the terminal board 210.

Then, the engagement projection plate portions 263, 264 of the break fixed contact terminal 260 are fitted into the engagement recess portions 211, 212 of the terminal board 210 with pressure, whereby the break fixed contact terminal 260 is fixed to the terminal board 210. Similarly to the aforementioned embodiment, the engagement projection plate portions 243, 244 are fitted into the engagement recess portions 213, 214 of the terminal board 210 with pressure, whereby the make fixed contact terminal 240 is fixed to the terminal board 210.

Figure 22:
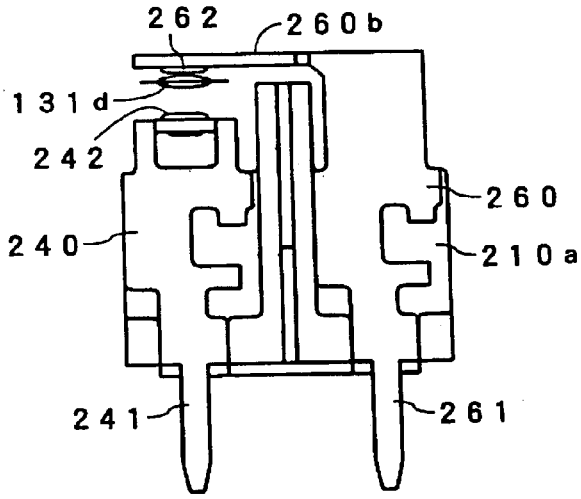
FIG. 22 is a diagram to which reference will be made in explaining a terminal board assembly of an electromagnetic relay according to other embodiment of the present invention.

As described above, the terminal board assembly 200 according to this embodiment is formed. FIG. 22 shows the terminal board assembly 200 from the side of the plate surface 210*a* of the terminal board 210. As shown in FIG. 22, the fixed contact 262 of the break fixed contact terminal 260 opposes the fixed contact 242 of the make fixed contact terminal 240 and the movable contact 131*d* is located between the fixed contacts 262 and 242.

In the case of this embodiment, the convex band 221 exists between the break fixed contact terminal 260 and the make fixed contact terminal 240 with exactly the same action and effects being achieved.

While the terminal board 210 includes the convex band 221 and the end face of the tip end of the convex band 221 contacts with the inner wall surface 401 of the cover 400 to isolate a plurality of fixed contact terminals so that the short-circuit caused by metal shavings can be prevented as described above, the arrangement for isolating a plurality of fixed contact terminals is not limited to the above-mentioned example.

Figure 23A:
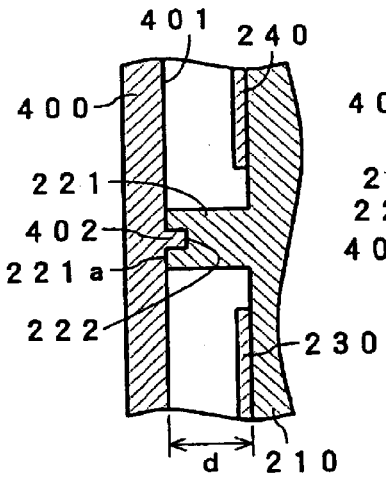
FIGS. 23A to 23C are diagrams to which reference will be made in explaining a main portion of an electromagnetic relay according to other embodiment of the present invention, respectively.

As shown in FIG. 23A, for example, the inner wall surface 401 of the cover 400 may include a narrow rib 402 that can be fitted into the corresponding narrow groove 222 of the convex band 221 of the terminal board 210. Thus, when the electromagnetic relay main body 300 is inserted into the cover 400, the narrow rib 402 of the inner wall surface 401 of the cover 400 may be inserted into and engaged to the inside of the narrow groove 222 of the convex band 221 of the terminal board 210. In that case, it is not necessary that the end face 221*a* of the convex band 221 of the terminal board 210 contact with the inner wall surface 401 of the cover 400.

Figure 23B:
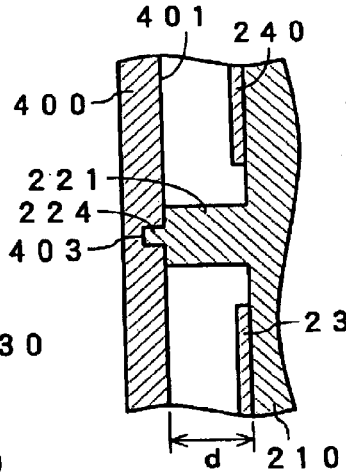

As shown in FIG. 23B, the cover 400 may include a narrow groove 403 formed on the inner wall surface 401 thereof and the convex band 221 of the terminal board 210 may have the narrow rib 224 that can be fitted into then narrow groove 403. A modified example of FIG. 23B is also possible in which the cover 400 may include a recess portion that engages the end face portion of the tip end of the convex band 221, and that is formed at its inner wall surface 401 instead of the narrow groove 403. In that case the convex band 221 of the terminal board 210 need not have the narrow rib 224 and the convex band 221 may be fitted into the above recess portion.

Figure 23C:
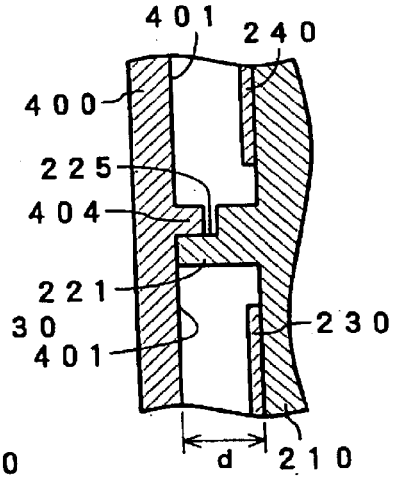

As shown in FIG. 23C, the convex band 221 of the terminal board 210 may be shaped so as to have a stepped portion 225 and the cover 400 may include a projection portion 404 that can engage with this stepped portion 225. In that case, the stepped portion 225 and the projection portion 403 need not be shaped so that they can engage with each other with high accuracy. In short, the stepped portion 225 and the projection portion 403 may be shaped so that they can isolate a plurality of fixed contact terminals from a space standpoint.

Figure 24A:
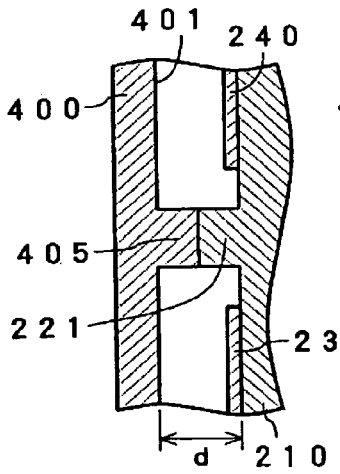
FIGS. 24A to 24C are diagrams to which reference will be made in explaining a main portion of an electromagnetic relay according to other embodiment of the present invention, respectively.
Figure 24B:
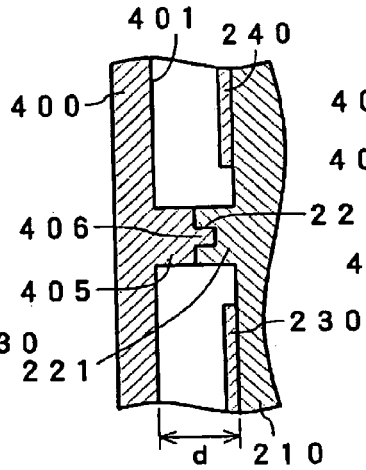

As shown in FIG. 24A, the cover 400 may include at its inner wall surface 401 a rib 405 including an end face that contacts with the end face of the tip end of the convex band 221 provided on the terminal board 210. The end face of the tip end of the convex band 221 and 405 where the convex band 221 and 405 contact with each other need not be formed as a flat end face as shown in FIG. 24A but one end face of the tip end may include a narrow rib and the other end face of the tip end may include a recess groove. FIG. 24B shows a modified example in which the rib 405 on the inner wall surface 401 of the cover 400 may include a narrow rib 406 formed on its end face and the convex band 221 of the terminal board 210 may include a recess groove 226.

Figure 24C:
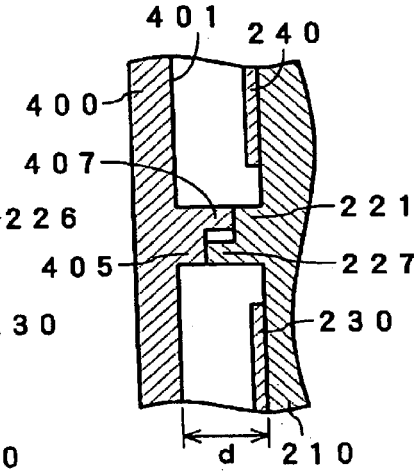

As shown in FIG. 24C, both of the convex band 221 and 406 may include stepped portions 227 and 407 formed at their end faces of the tip ends and these stepped portions 227, 407 may engage with each other. In that case, the stepped portions 227, 407 need not be shaped so that they can engage with each other at high accuracy. In short, the stepped portions 227, 407 may be shaped such that they can isolate a plurality of fixed contact terminals from a space standpoint.

Figure 25A:
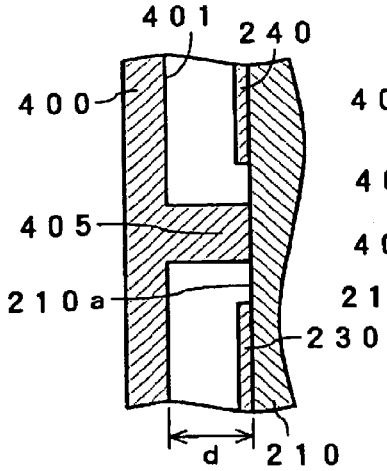
FIGS. 25A to 25C are diagrams to which reference will be made in explaining a main portion of an electromagnetic relay according to other embodiment of the present invention, respectively.

As shown in FIG. 25A, the terminal board 210 need not include the rib but the height of the rib 405 disposed on the inner wall surface 401 of the cover 400 may be selected to be equal to a distance d between the inner wall surface of the cover 400 and the surface 210*a* of the terminal board 210, so that the end face of the tip end of the rib 405 may contact with the surface 210*a* of the terminal board 210.

Figure 25B:
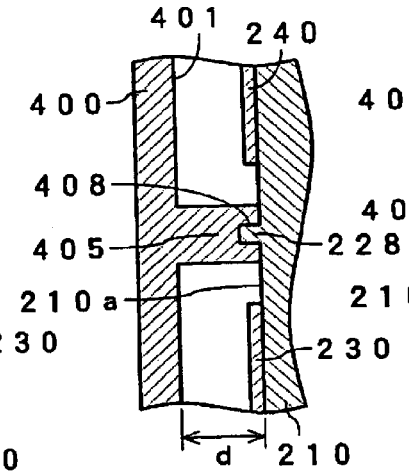

As shown in FIG. 25B, the terminal board 210 may include a narrow rib 228 formed at its portion in which it contacts with the end face of the rib 405 and the rib 405 may include a recess groove 408 formed at its end face so that the narrow rib 228 and the recess groove 408 may engage with each other.

Figure 25C:
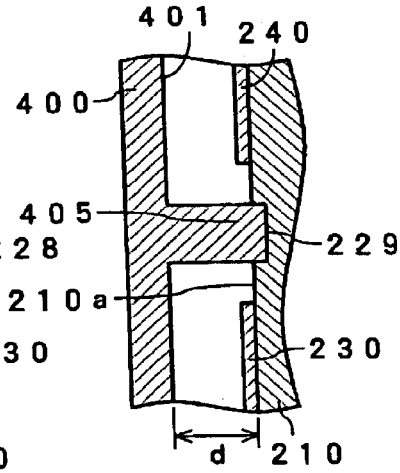

As shown in FIG. 25C, the height of the rib 405 disposed on the inner wall surface 401 of the cover 400 may be selected to be slightly larger than the distance d between the inner wall surface of the cover 400 and the surface 210*a* of the terminal board 210 and the terminal board 210 may include a recess groove 229 formed at its surface 210*a* so that the whole of the tip end face of the rib 405 disposed on the inner wall surface 401 of the cover 400 may engage with this recess groove 229.

While the two fixed contact terminals are separated and isolated from each other as described above, the present invention is not limited thereto and can similarly be applied to the case in which the terminal board includes more than three fixed contact terminals and the three fixed contact terminals or more are separated and isolated from each other.

Further, while the electromagnetic relay includes one electromagnet assembly as described above, the present invention is not limited to thereto and the present invention can of course be applied to the case in which a plurality of electromagnet assemblies may be fitted into one terminal board assembly to form an electromagnetic relay assembly.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An electromagnetic relay comprising:

a plurality of fixed contact terminals;

a back-stop metal;

a main body assembly formed by combining an electromagnetic assembly with an armature assembly;

a terminal board having a plurality of pocket shaped recess portions engaged with said plurality of fixed contact terminals, and a convex band located on said terminal board so as to isolate said plurality of fixed contact terminals from each other, said convex band including a groove into which said back-stop metal is inserted; and a cover for receiving an electromagnetic relay main body formed by combining said main body assembly with said terminal board.

2. An electromagnetic relay comprising:

a plurality of fixed contact terminals;

a main body assembly formed by combining an electromagnetic assembly with an armature assembly;

a terminal board having a plurality of pocket shaped recess portions engaged with some of said plurality of fixed contact terminals, and a convex band located on said terminal board so as to isolate said plurality of fixed contact terminals from each other, said convex band including a groove into which one of said plurality of fixed contact terminals is inserted; and a cover for receiving an electromagnetic relay main body formed by combining said main body assembly with said terminal board.

* * * * *